US008579617B2

(12) United States Patent
Ono et al.

(10) Patent No.: US 8,579,617 B2
(45) Date of Patent: Nov. 12, 2013

(54) OIL PUMP ROTOR

(75) Inventors: Hisashi Ono, Okazaki (JP); Koji Nunami, Anjo (JP)

(73) Assignee: Aisin Seiki Kabushiki Kaisha, Kariya-shi, Aichi (JP)

( * ) Notice: Subject to any disclaimer, the term of this patent is extended or adjusted under 35 U.S.C. 154(b) by 109 days.

(21) Appl. No.: 13/342,849

(22) Filed: Jan. 3, 2012

(65) Prior Publication Data

US 2012/0128520 A1 May 24, 2012

Related U.S. Application Data

(62) Division of application No. 11/990,656, filed as application No. PCT/JP2006/318769 on Sep. 21, 2006, now Pat. No. 8,096,795.

(30) Foreign Application Priority Data

Sep. 22, 2005 (JP) ..... 2005-275506
Apr. 14, 2006 (JP) ..... 2006-111453

(51) Int. Cl.
*F01C 21/10* (2006.01)
*F04C 2/18* (2006.01)

(52) U.S. Cl.
USPC ..... 418/150; 418/61.3

(58) Field of Classification Search
USPC ..... 418/61.3, 150
See application file for complete search history.

(56) References Cited

U.S. PATENT DOCUMENTS 2,965,039 A 12/1960 Morita
3,226,013 A 12/1965 Toyoda et al.
3,716,314 A 2/1973 Takahashi
3,955,903 A 5/1976 de Dobo
5,114,325 A 5/1992 Morita (Continued)

FOREIGN PATENT DOCUMENTS

EP 1 655 490 A1 5/2006
JP 61-008484 1/1986

(Continued)

OTHER PUBLICATIONS

International Search Report for PCT/JP2006/318769, mailed Oct. 31, 2006.

(Continued)

*Primary Examiner* — Mary A Davis
(74) *Attorney, Agent, or Firm* — Stites & Harbison PLLC; Juan Carlos a. Marquez, Esq.

(57) ABSTRACT

An oil pump rotor includes an inner rotor having (n) external teeth, an outer rotor having (n+1) internal teeth, and a casing forming a suction port and a discharge port for drawing/discharging fluid. In operation, fluid is drawn/discharged according to volume changes of cells formed between tooth faces. A tooth profile based on a mathematical curve has a tooth addendum circle A1 with a radius $R_{A1}$ and a tooth root curve A2 with a radius $R_{A2}$, a circle D1 has a radius $R_{D1}$ satisfying Formula (1), and a circle D2 has a radius $R_{D2}$ satisfying both Formulas (2) and (3):

$$R_{A1}>R_{D1}>R_{A2} \quad \text{Formula (1)}$$

$$R_{A1}>R_{D2}>R_{A2} \quad \text{Formula (2)}$$

$$R_{D1}\geq R_{D2} \quad \text{Formula (3)}$$

A tooth profile of the external teeth includes a modification either, in a radially outer direction, on the outer side of the circle D1 or, in a radially inner direction, on the inner side of the circle D2.

12 Claims, 17 Drawing Sheets

(56) References Cited

U.S. PATENT DOCUMENTS

| | | | | |
|---|---|---|---|---|
| 5,368,455 | A | 11/1994 | Eisenmann | |
| 5,762,484 | A | 6/1998 | Whitham | |
| 5,876,193 | A | 3/1999 | Hosono et al. | |
| 6,244,843 | B1 | 6/2001 | Kosuge | |
| 6,893,238 | B2 | 5/2005 | Eisenmann et al. | |
| 7,118,359 | B2 | 10/2006 | Hosono | |
| 7,226,279 | B2 | 6/2007 | Andoskin et al. | |
| 7,427,192 | B2 | 9/2008 | Lamparski et al. | |
| 2003/0165392 | A1 | 9/2003 | Hosono | |
| 2004/0009085 | A1 | 1/2004 | Lamparski et al. | |
| 2004/0022660 | A1 | 2/2004 | Eisenmann et al. | |
| 2004/0067150 | A1 * | 4/2004 | Hirabayashi et al. | 418/166 |
| 2006/0171834 | A1 | 8/2006 | Ogata | |
| 2006/0171843 | A1 | 8/2006 | Spears | |
| 2007/0065327 | A1 | 3/2007 | Hosono | |

FOREIGN PATENT DOCUMENTS

| | | |
|---|---|---|
| JP | 63-126568 | 8/1988 |
| JP | 64-032083 | 2/1989 |
| JP | 09-256963 | 9/1997 |
| JP | 2003-56473 | 2/2003 |
| JP | 2003-322088 | 11/2003 |
| JP | 2004-036588 | 2/2004 |
| JP | 2005-036735 | 2/2005 |
| JP | 2005-076563 | 3/2005 |
| JP | 2005-090493 | 4/2005 |
| JP | 2006-009616 | 12/2006 |

OTHER PUBLICATIONS

Definitions of Epicycloid and Hypocycloid copied from www.Dictionary.com on May 8, 2010 using the search terms "epicycloid" and "hypocycloid", pp. 1 and 2.

Supplementary Search Report form the European Patent Office for EP 06798208.2-1267/1927752 PCT/JP2006/318769, mailed May 12, 2010.

Office Action issued on Jul. 22, 2010 from Japanese Patent Office for JP-2006-256141.

* cited by examiner (a)

(b)

OIL PUMP ROTOR

CROSS-REFERENCE TO RELATED APPLICATIONS

This application is a Divisional of U.S. application Ser. No. 11/990,656 filed on Feb. 29, 2008. Priority is claimed based on U.S. application Ser. No. 11/990,656 filed on Feb. 29, 2008, all of which is incorporated by reference.

TECHNICAL FIELD

The present invention relates to an oil pump rotor operable to draw/discharge a fluid according to volume change of cells formed between an inner rotor and an outer rotor.

BACKGROUND ART

A conventional. oil pump includes an inner rotor having (n: "n" is a natural number) external teeth, an outer rotor having (n+1) internal teeth meshing with the external teeth, and a casing forming a suction port for drawing the fluid and a discharge port for discharging the fluid In association with rotation of the inner rotor, the external teeth thereof mesh with the internal teeth of the outer rotor, thus rotating this outer rotor and the fluid is drawn/discharged according to volume changes of a plurality of cells formed between the two rotors.

On its forward side and rear side along its rotational direction, each cell is delimited by the contact between the external teeth of the inner rotor and the internal teeth of the outer rotor, and on respective opposed lateral sides thereof, the cell is delimited by the casing. With these, there is formed an independent fluid conveying chamber. In the course of the meshing process between the external teeth and the internal teeth, the volume of each cell becomes minimum and then increases, thereby drawing the fluid as the cell moves along the suction port. Then, after the volume becomes maximum, the volume decreases, thereby discharging the fluid, as the cell moves along the discharge port.

The oil pump having the above-described construction, due to its compact and simple construction, is widely used as a lubricant oil pump for a motorcar, an automatic speed change oil pump for a motorcar, etc. In case the oil pump is mounted in a motorcar, as a driving means for this oil pump, there is known a crankshaft direct drive in which the inner rotor is directly coupled with the engine crankshaft so that the pump is driven by engine revolution.

Incidentally, as examples of oil pump, various types are disclosed, including a type using an inner rotor and an outer rotor whose teeth are formed of a cycloid curve (e.g. Patent Document 1), a further type using an inner rotor whose teeth are formed of an envelope of a family of arcs having centers on a trochoid curve (e.g. Patent Document 2), a still further type using an inner rotor and an outer rotor whose teach are formed of two arcs tangent to each other (e.g. Patent Document 3), and a still further type using an inner rotor and an outer rotor whose tooth profiles comprise modifications of the above-described respective types.

In recent years, there is witnessed increasing tendency of the discharge capacity of the oil pump, due to e.g. change in the engine valve operating system, addition of a piston cooling oil jet associated with increased output. On the other hand, for reduction of friction in the engine in view point of fuel saving, there is a need for reducing the size/diameter of the oil pump. Increase of the discharge amount of oil pump is generally realized by reduction in the number of teeth. However, such reduction in the number of teeth of the oil pump results in increase in the discharge amount per each cell, thus leading to increase in ripple, which leads, in turn, to vibration of e.g. a pump housing and generation of noise associated therewith.

As a technique to reduce the ripple so as to restrict noise generation, the commonly employed method is to increase the number of teeth. However, increase in the number of teeth for a waveform formed by e.g. a theoretical cycloid curve, results in reduction in the discharge amount. So that, in order to ensure a required discharge amount, this requires either enlargement of the outer diameter of the rotor or increase in the axial thickness thereof. Consequently, there is invited such problem as enlargement, weight increase, increase of friction, etc.

Patent Document 1: Japanese Patent Application "Kokai" No. 2005-076563

Patent Document 2: Japanese Patent Application "Kokai" No. 09-256963

Patent Document 3: Japanese Patent Application "Kokai" No. 61-008484

DISCLOSURE OF INVENTION

Object to be Achieved by Invention

The object of the present invention is to provide an oil pump rotor which can provide an increased discharge amount without enlargement in the outer diameter or the axial thickness of the rotor.

Means to Achieve the Object

For accomplishing the above-noted object, according to a first technical means, an oil pump rotor for use in an oil pump including an inner rotor having (n: "n" is a natural number) external teeth, an outer rotor having (n+1) internal teeth meshing with the external teeth, and a casing forming a suction port for drawing a fluid and a discharge port for discharging the fluid, such that in association with meshing and co-rotation of the inner and outer rotors, the fluid is drawn/discharged to be conveyed according to volume changes of cells formed between teeth faces of the two rotors;

wherein, for a tooth profile formed of a mathematical curve and having a tooth addendum circle $A_1$ with a radius $R_{A1}$ and a tooth root curve $A_2$ with a radius $R_{A2}$, a circle $D_1$ has a radius $R_{D1}$ which satisfies Formula (1) and a circle $D_2$ has a radius $R_{D2}$ which satisfies both Formula (2) and Formula (3), $$R_{A1}>R_{D1}>R_{A2} \quad \text{Formula (1)}$$

$$R_{A1}>R_{D2}>R_{A2} \quad \text{Formula (2)}$$

$$R_{D1}\geq R_{D2} \quad \text{Formula (3)}$$

a tooth profile of the external teeth of the inner rotor comprises at least either one of a modification, in a radially outer direction, of said tooth profile, on the outer side of said circle $D_1$ and a modification, in a radially inner direction, of said tooth profile, on the inner side of said circle $D_2$.

Here, the term "mathematical curve" refers to a curve represented by using a mathematical function, including a cycloid curve, an envelope of a family of arcs having centers on a trochoid curve, an arcuate curve formed of two arcs tangent to each other, etc.

According to a second technical means, in the first technical means described above, said tooth profile of the external teeth of the inner rotor is formed of both the radially outer modification of the tooth profile, on the outer side of the circle $D_1$ having the radius $R_{D1}$ satisfying said Formula (1) and the radially inner modification of said tooth profile, on the inner side of the circle $D_2$ having the radius $R_{D2}$ satisfying both Formula (2) and Formula (3).

According to a third technical means, in the first or second technical means described above, said mathematical curve comprises a cycloid curve represented by Formulas (4) through (8); and said external tooth profile of the inner rotor, in the case of said modification on the outer side of the circle $D_1$, has an addendum profile represented by coordinates obtained by Formulas (9) through (12), whereas said external tooth profile of the inner rotor, in the case of said modification on the inner side of the circle $D_2$, has a root profile represented by coordinates obtained by Formulas (13) through (16), $$X_{10}=(R_A+R_{a1})\times\cos\theta_{10}-R_{a1}\times\cos[\{(R_A+R_{a1})/R_{a1}\}\times\theta_{10}] \quad \text{Formula (4)}$$

$$Y_{10}=(R_A+R_{a1})\times\sin\theta_{10}-R_{a1}\times\sin[\{(R_A+R_{a1})/R_{a1}\}\times\theta_{10}] \quad \text{Formula (5)}$$

$$X_{20}=(R_a-R_{a2})\times\cos\theta_{20}+R_{a2}\times\cos[\{(R_{a2}-R_A)/R_{a2}\}\times\theta_{20}] \quad \text{Formula (6)}$$

$$Y_{20}=(R_A-R_{a2})\times\sin\theta_{20}+R_{a2}\times\sin[\{(R_{a2}-R_A)/R_{a2}\}\times\theta_{20}] \quad \text{Formula (7);}$$

$$R_A=n\times(R_{a1}+R_{a2}) \quad \text{Formula (8)}$$

where

X axis: the straight line extending through the center of the inner rotor,

Y axis: the straight line perpendicular to the X axis and extending through the center of the inner rotor, $R_A$: the radius of a basic circle of the cycloid curve, $R_{a1}$: the radius of an epicycloid of the cycloid curve, $R_{a2}$: the radius of a hypocycloid of the cycloid curve, $\theta_{10}$: an angle formed between the X axis and a straight line extending through the center of the epicycloid and the center of the inner rotor, $\theta_{20}$: an angle formed between the X axis and a straight line extending through the center of the hypocycloid and the center of the inner rotor, $(X_{10}, Y_{10})$: coordinates of the cycloid curve formed by the epicycloid, and $(X_{20}, Y_{20})$. coordinates of the cycloid curve formed by the hypocycloid, $$R_{11}=(X_{10}^2+Y_{10}^2)^{1/2} \quad \text{Formula (9)}$$

$$\theta_{11}=\arccos(X_{10}/R^{11}) \quad \text{Formula (10)}$$

$$X_{11}=\{(R_{11}-R_{D1})\times\beta_{10}+R_{D1}\}\times\cos\theta_{11} \quad \text{Formula (11)}$$

$$Y_{11}=\{(R_{11}-R_{D1})\times\beta_{10}+R_{D1}\}\times\sin\theta_{11} \quad \text{Formula (12)}$$

where, $R_{11}$: a distance from the inner rotor center to the coordinates $(X_{10}, Y_{10})$, $\theta_{11}$: an angle formed between the X axis and the straight line extending through the inner rotor center and the coordinates $(X_{10}\ Y_{10})$, $(X_{11}, Y_{11})$: coordinates of the addendum profile after modification, and β10: a correction factor for modification $$R_{21}=(X_{20}^2+Y_{20}^2)^{1/2} \quad \text{Formula (13)}$$

$$\theta_{21}=\arccos(X_{20}/R_{21}) \quad \text{Formula (14)}$$

$$X_{21}=\{R_{D2}-(R_{D2}-R_{21})\times\beta_{20}\}\times\cos\theta_{21} \quad \text{Formula (15)}$$

$$Y_{21}=\{R_{D2}-(R_{D2}-R_{21})\times\beta_{20}\}\times\sin\theta_{21} \quad \text{Formula (16)}$$

where, $R_{21}$: a distance from the inner rotor center to the coordinates $(X_{20}, Y_{20})$, $\theta_{21}$: an angle formed between the X axis and the straight line extending through the inner rotor center and the coordinates $(X_{20}, Y_{20})$, $(X_{21}, Y_{21})$: coordinates of the root profile after modification, and $\beta_{20}$: a correction factor for modification According to a fourth technical means, in the first or second technical means described above, said mathematical curve comprises an envelope of a family of arcs having centers on a trochoid curve defined by Formulas (21) through (26), and relative to said addendum circle Ai and said root circle A2, said external tooth profile of the inner rotor, in the case of the modification on the outer side of the circle D1, has an addendum profile represented by coordinates obtained by Formulas (27) through (30), whereas said external tooth profile of the inner rotor, in the case of the modification on the inner side of the circle $_{D2}$, has a root profile represented by coordinates obtained by Formulas (31) through (34), $$X_{100}=(R_H+R_I)\times\cos\theta_{100}-e_K\times\cos\theta_{101} \quad \text{Formula (21)}$$

$$Y_{100}=(R_H+R_I)\times\sin\theta_{100}-e_K\times\sin\theta_{101} \quad \text{Formula (22)}$$

$$\theta_{101}=(n+1)\times\theta_{100} \quad \text{Formula (23)}$$

$$R_H=n\times R_1 \quad \text{Formula (24)}$$

$$X_{101}=X_{100}\pm R_J/\{1+(dX_{100}/dY_{100})^2\}^{1/2} \quad \text{Formula (25)}$$

$$Y_{101}=X_{100}\pm R_J/\{1+(dX_{100}/dY_{100})^2\}^{1/2} \quad \text{Formula (26)}$$

where,

X axis: the straight line extending through the center of the inner rotor,

Y axis: the straight line perpendicular to the X axis and extending through the center of the inner rotor, $(X_{100}, Y_{100})$: coordinates on the trochoid curve, $R_H$: the radius of a basic circle of the trochoid curve, $R_I$: the radius of a trochoid curve generating circle, $e_K$: a distance between the center of the trochoid curve generating circle and a point generating the trochoid curve, $\theta_{100}$: an angle formed between the X axis and a straight line extending through the center of the trochoid curve generating circle and the inner rotor center, $\theta_{101}$: an angle formed between the X axis and a straight line extending through the center of the trochoid curve generating circle and the trochoid curve generating point, $X_{101}, Y_{101})$: coordinates on the envelope, and $R_J$: the radius of the arcs E forming the envelope.

$$R_{11}=(X_{101}^2+Y_{101}^2)^{1/2} \quad \text{Formula (27)}$$

$$\theta_{102}=\arccos(X_{101}/R_{11}) \quad \text{Formula (28)}$$

$$X_{102}=\{(R_{11}-R_{D1})\times\beta_{100}+R_{D1}\}\times\cos\theta_{102} \quad \text{Formula (29)}$$

$$Y_{102}=\{(R_{11}-R_{D1})\times\beta_{100}+R_{D1}\}\times\sin\theta_{102} \quad \text{Formula (30)}$$

where, $R_{11}$: a distance from the inner rotor center to the coordinates $(X_{101}, Y_{101})$, $\theta_{102}$: an angle formed between the X axis and the straight line extending through the inner rotor center and the straight line extending through the coordinates $(X_{101}, Y_{101})$, $(X_{102}, Y_{102})$: coordinates of the addendum profile after modification, and a $\beta_{100}$: a correction factor for modification $$R_{21}=(X_{101}^2+Y_{101}^2)^{1/2} \quad \text{Formula (31)}$$

$$\theta_{103}=\arccos(X_{101}/R_{21}) \quad \text{Formula (32)}$$

$$X_{103}=\{R_{D2}-(R_{D2}-R_{21})\times\beta_{101}\}\times\cos\theta_{103} \quad \text{Formula (33)}$$

$$Y_{103}=\{R_{D2}-(R_{D2}-R_{21})\times\beta_{101}\}\times\sin\theta_{103} \quad \text{Formula (34)}$$

where, $R_{21}$: a distance from the inner rotor center to the coordinates $(X_{101}, Y_{101})$, $\theta_{103}$: an angle formed between the X axis and the straight line extending through the inner rotor center and the straight line extending through the coordinates $(X_{101}, Y_{101})$, $(X_{103}, Y_{103})$: coordinates of the root profile after modification, and $\beta_{101}$: a correction factor for modification.

According to a fifth technical means, in the first or second technical means described above, said mathematical curve is formed by two arcs having an addendum portion and a root portion tangent to each other and is an arcuate curve represented by Formulas (41) through (46), and said external tooth profile of the inner rotor, in the case of the modification on the outer side of the circle D1, has an addendum profile represented by coordinates obtained by Formulas (47) through (50), whereas said external tooth profile of the inner rotor, in the case of the modification on the inner side of the circle $_{D2}$, has a root profile represented by coordinates obtained by Formulas (51) through (54).

$$(X_{50}-X_{60})^2+(Y_{50}-Y_{60})^2=(r_{50}+r_{60})^2 \quad \text{Formula (41)}$$

$$X_{60}=(R_{A2}+r_{60})\cos\theta_{60} \quad \text{Formula (42)}$$

$$Y_{60}=(R_{A2}+r_{80})\sin\theta_{60} \quad \text{Formula (43)}$$

$$X_{50}=R_{A1}-r_{50} \quad \text{Formula (44)}$$

$$Y_{50}=0 \quad \text{Formula (45)}$$

$$\theta_{60}=\pi/n \quad \text{Formula (46)}$$

where,

X axis: a straight line extending through the center of the inner rotor,

Y axis: a straight line perpendicular to the X axis and extending through the center of the inner rotor, $(X_{50}, Y_{50})$: coordinates of the center of the arc forming the tooth addendum portion, $(X_{60}, Y_{60})$: coordinates of the center of the arc forming the tooth root portion, $r_{50}$: the radius of the arc forming the tooth addendum portion, $r_{60}$: the radius of the arc forming the tooth root portion, $\theta_{60}$: an angle formed between the straight line extending through the center of the arc forming the tooth addendum portion and the center of the inner rotor and the straight line extending through the center of the arc forming the tooth root portion and the center of the inner rotor, $$R_{51}=(X_{51}^2+Y_{51}^2)^{1/2} \quad \text{Formula (47)}$$

$$\theta_{51}=\arccos(X_{51}/R_{51}) \quad \text{Formula (48)}$$

$$X_{52}=\{(R_{51}-R_{D1})\times\beta_{50}+R_{D1}\}\times\cos\theta_{51} \quad \text{Formula (49)}$$

$$Y_{52}=\{(R_{51}-R_{D1})\times\beta_{50}+R_{D1}\}\times\sin\theta_{51} \quad \text{Formula (50)}$$

where, $(X_{51}, Y_{51})$: coordinates of the points on the arc forming the tooth addendum portion, $R_{51}$: a distance from the center of the inner rotor to the coordinates $(X_{51}, Y_{51})$, $\theta_{51}$: an angle formed between the X axis and the straight line extending through the center of the inner rotor and the coordinates $(X_{51}, Y_{51})$, $(X_{52}, Y_{52})$: the coordinates of the addendum profile after the modification, Q 50: a correction factor for modification.

$$R_{61}=(X_{61}^2+Y_{61}^2)^{1/2} \quad \text{Formula (51)}$$

$$\theta_{61}=\arccos(X_{61}/R_{61}) \quad \text{Formula (52)}$$

$$X_{62}=\{(R_{D2}-(R_{D2}-R_{61})\times\beta_{60}\}\times\cos\theta_{61} \quad \text{Formula (53)}$$

$$Y_{62}=\{(R_{D2}-(R_{D2}-R_{61})\times\beta_{60}\}\times\cos\theta_{61} \quad \text{Formula (54)}$$

where, $(X_{61}, Y_{61})$: coordinates of the points on the arc forming the tooth root portion, $R_{61}$: a distance from the center of the inner rotor to the coordinates $(X_{61}, Y_{61})$, $\theta_{61}$: an angle formed between the X axis and the straight line extending through the center of the inner rotor and the coordinates $(X_{61}, Y_{61})$, $(X_{62}, Y_{62})$: the coordinates of the root profile after the modification, $\beta_{60}$: a correction factor for modification.

According to the sixth technical means, in the first or second technical means described above, the outer rotor meshing with the inner rotor has a tooth profile formed by a method comprising the steps of:

revolving the inner rotor in a direction on a perimeter of a circle (D) at an angular velocity (ω), said circle (D) having a center offset from the center of the inner rotor by a predetermined distance (e) and having a radius (e) equal to said predetermined distance;

rotating, at the same time, the inner rotor on its own axis in the direction opposite to said direction of revolution at an angular velocity (ω/n) which is 1/n times said angular velocity (ω) of the revolution, thereby forming an envelope;

providing, as a 0-revolution angle direction, an angle as seen at the time of the start of the revolution from the center of said circle (D) toward the center of the inner rotor;

modifying vicinity of an intersection between said envelope and an axis along said 0-revolution angle direction toward a radially outer side, modifying vicinity of an intersection between said envelope and an axis along a π/(n+1) revolution angle direction of the inner rotor toward a radially outer side by an amount smaller than or equal to the amount of said radially outer modification of the vicinity of the intersection with the 0-revolution angle axis;

extracting a portion of said envelope contained in an angular area greater than 0-revolution angle and less than it π/(n+1) revolution angle, as a partial envelope;

rotating said partial envelope by a small angle (α) along the revolution direction about the center of said circle (D), removing a further portion of said envelope extending out of said angular area and connecting, to said removed portion, a gap formed between said partial envelope and said 0-revolution angle axis, thereby forming a corrected partial envelope;

copying said corrected partial envelope in line symmetry relative to said 0-revolution angle axis, thereby forming a partial tooth profile; and copying said partial tooth profile by rotating it about the center of said circle (D) for a plurality of times for an angle: 2 π/(n+1) for each time, thereby forming the tooth profile of the outer rotor.

According to a seventh technical means, in the third technical means described above, relative to a tooth profile formed by a cycloid curve represented by Formulas (61) through (65) and having a root circle $B_1$ with a radius $R_{B1}$ and an addendum circle $B_2$ with a radius $R_{B2}$;

the internal tooth profile of the outer rotor meshing with the inner rotor has a root profile represented by Formulas (66) through (69) in case said internal tooth profile is provided as a modification on the outer side of a circle $D_3$ having a radius $R_{D3}$ satisfying: $R_{B1}>R_{D3}>R_{B2}$;

the internal tooth profile of the outer rotor meshing with the inner rotor has an addendum profile represented by Formulas (70) through (73) in case said internal tooth profile is provided as a modification on the inner side of a circle $D_4$ having a radius $R_{D4}$ satisfying $R_{B1}>R_{D4}>R_{B2}$ and $R_{D3}>R_{D4}$; and said internal tooth profile of the outer rotor satisfies the following relationships of Formulas (74) through (76) relative to the inner rotor;

$$X_{30}=(R_B+R_{b1})\cos\theta_{30}-R_{b1}\times\cos[\{(R_B+R_{b1})/R_{b1}\}\times\theta_{30}] \quad \text{Formula (61)}$$

$$Y_{30}=(R_B+R_{b1})\sin\theta_{30}-R_{b1}\times\sin[\{(R_B+R_{b1})/R_{b1}\}\times\theta_{30}] \quad \text{Formula (62)}$$

$$X_{40}=(R_B-R_{b2})\cos\theta_{40}+R_{b2}\times\cos[\{(R_{b2}-R_B)/R_{b2}\}\times\theta_{40}] \quad \text{Formula (63)}$$

$$Y_{40}=(R_B-R_{b2})\sin\theta_{40}+R_{b2}\times\sin[\{(R_{b2}-R_B)/R_{b2}\}\times\theta_{40}] \quad \text{Formula (64)}$$

$$R_B=(n+1)\times(R_{b1}+R_{b2}) \quad \text{Formula (65)}$$

where,

X axis: a straight line extending through the center of the outer rotor,

Y axis: a straight line perpendicular to the X axis and extending through the center of the outer rotor, RB: the radius of a basic circle of the cycloid curve, Rb1: the radius of an epicycloid of the cycloid curve, Rb2: the radius of a hypocycloid of the cycloid curve, 0 30: an angle formed between the X axis and a straight line extending through the center of the epicycloid and the center of the outer rotor, 0 4o: an angle formed between the X axis and a straight line extending through the center of the hypocycloid and the center of the outer rotor, (X30, Y30): coordinates of the cycloid curve formed by the epicycloid, and (X4o, Y4o): coordinates of the cycloid curve formed by the hypocycloid, $$R_{31}=(X_{30}^2+Y_{30}^2)^{1/2} \quad \text{Formula (66)}$$

$$\theta_{31}=\arccos(X_{30}/R_{31}) \quad \text{Formula (67)}$$

$$X_{31}=\{(R_{31}-R_{D3})\times\beta_{30}+R_{D3}\}\times\cos\theta_{31} \quad \text{Formula (68)}$$

$$Y_{31}=\{(R_{31}-R_{D3})\times\beta_{30}+R_{D3}\}\times\sin\theta_{31} \quad \text{Formula (69)}$$

where,

R31: a distance from the outer rotor center to the coordinates (X30, Y30), 0 31: an angle formed between the X axis and the straight line extending through the outer rotor center and the coordinates (X30, Y30), (X31, Y31): coordinates of the root profile after modification, and Q 30: a correction factor for modification $$R_{41}=(X_{40}^2+Y_{40}^2)^{1/2} \quad \text{Formula (70)}$$

$$\theta_{41}=\arccos(X_{40}/R_{41}) \quad \text{Formula (71)}$$

$$X_{41}=\{R_{D4}-(R_{D4}-R_{41})\times\beta_{40}\}\times\cos\theta_{41} \quad \text{Formula (72)}$$

$$Y_{41}=\{R_{D4}-(R_{D4}-R_{41})\times\beta_{40}\}\times\sin\theta_{41} \quad \text{Formula (73)}$$

where,

R41: a distance from the outer rotor center to the coordinates (X40, Y40), 0 41: an angle formed between the X axis and the straight line extending through the outer rotor center and the coordinates (X40, Y40), (X41, Y41): coordinates of the addendum profile after modification, and /3 40: a correction factor for modification $$e_{10}=[\{(R_A+2\times R_{a1})-R_{D1}\}\times\beta_{10}+R_{D1}]-[R_{D2}-\{R_{D2}-(R_A-2\times R_{a2})\}\times\beta_{20}]/2+d_{10} \quad \text{Formula (74)}$$

$$R_{B10}'=3/2\times\{(R_A+2\times R_{a1})-R_{D1}\}\times\beta_{10}+R_{D1}]-1/2\times[R_{D2}-\{R_{D2}-(R_A-2\times R_{a2})\}\times\beta_{20}]+d_{20} \quad \text{Formula (75)}$$

$$R_{B20}'=[\{(R_A+2\times R_{a1})-R_{D1}\}\times\beta_{10}+R_{D1}]+[R_{D2}-\{R_{D2}-(R_A-2\times R_{a2})\}\times\beta_{20}\}]/2+d_{30} \quad \text{Formula (76)}$$

where, elo: a distance between the center of the inner rotor and the center of the outer rotor (eccentricity amount), RB1o': the radius of the root circle of the outer rotor after the modification, RB20': the radius of the addendum circle of the outer rotor after the modification, and d10, d2o, d30: correction amounts for allowing outer rotor rotation with clearance.

According to an eighth technical means, in the fourth technical means described above, relative to a tooth profile formed by an arcuate curve represented by Formulas (81) through (84) and having a root circle B1 with a radius RBI and an addendum circle B2 with a radius RB2;

the internal tooth profile of the outer rotor meshing with the inner rotor has a root profile represented by Formula (85) in case said internal tooth profile is provided as a modification on the outer side of a circle D3 having a radius RD3 satisfying: RBI>RD3>RB2;

the internal tooth profile of the outer rotor meshing with the inner rotor has an addendum profile represented by Formulas (86) and (87) in case said internal tooth profile is provided as a modification on the inner side of a circle D4 having a radius RD4 satisfying: RBI>RD4>RB2 and RD3 ? RD4;

$$(X_{200}-X_{210})^2+(Y_{200}-Y_{210})^2=R_J^2 \quad \text{Formula (81)}$$

$$X_{210}^2+Y_{210}^2=R_L^2 \quad \text{Formula (82)}$$

$$X_{220}^2+Y_{220}^2=R_{B1}^2 \quad \text{Formula (83)}$$

$$R_{B1}=(3\times R_{A1}-R_{A2})/2+g_{10} \quad \text{Formula (84)},$$

where,

X axis: a straight line extending through the center of the outer rotor,

Y axis: a straight line perpendicular to the X axis and extending through the outer rotor center, (X200, Y200): coordinates of an arc forming the addendum portion, (X210, Y210): coordinates of the center of the circle whose arc forms the addendum portion, (X220, Y220): coordinates of an arc of the addendum circle B1 forming the addendum portion, RL: a distance between the outer rotor center and the center of the circle forming whose arc forms the addendum portion, and RBI: a radius of the root circle B1 forming the root portion.

$$X_{230}^2+Y_{230}^2=R_{B1}'^2 \quad \text{Formula (85)}$$

where, (X230, Y230): coordinates of the root profile after the modification, and RB1': a radius of the arc forming the root portion after the modification.

$$X_{201}=(1-\beta_{200})\times R_{D4}\times\cos\theta_{200}+X_{200}\times\beta_{200}+g_{20} \quad \text{Formula (86)}$$

$$Y_{201}=(1-\beta_{200})\times R_{D4}\times\sin\theta_{200}+Y_{200}\times\beta_{200}+g_{30} \quad \text{Formula (87)}$$

where, (X201, Y201): coordinates of the addendum profile after the modification, 0 200: an angle formed between the X axis and the straight line extending through the outer rotor center and the point (X200, Y200), Q 200: a correction factor for modification, and G1o, g2o, g3o: correction amounts for allowing outer rotor rotation with clearance.

According to a ninth technical means, in the fifth technical means described above, relative to a tooth profile formed by an arcuate curve represented by Formulas (101) through (106) and having a root circle B1 with a radius RB1 and an addendum circle B2 with a radius RB2;

the internal tooth profile of the outer rotor meshing with the inner rotor has a root profile represented by Formulas (107) through (110) in case said internal tooth profile is provided as a modification on the outer side of a circle D3 having a radius RD3 satisfying: RBI>RD3>RB2;

the internal tooth profile of the outer rotor meshing with the inner rotor has an addendum profile represented by Formulas (111) through (114) in case said internal tooth profile is provided as a modification on the inner side of a circle D4 having a radius RD4 satisfying: RBI>RD4>RB2 and RD3 RD4; and the internal tooth profile of the outer rotor satisfies the following relationships of Formulas (115) through (117) relative to the inner rotor;

$$(X_{70}-Y_{80})^2+(Y_{70}-Y_{80})^2=(r_{70}+r_{80})^2 \quad \text{Formula (101)}$$

$$X_{80}=(R_{B2}+r_{80})\cos\theta_{80} \quad \text{Formula (102)}$$

$$Y_{80}=(R_{B2}+r_{80})\sin\theta_{80} \quad \text{Formula (103)}$$

$$X_{70}=R_{B1}-r_{70} \quad \text{Formula (104)}$$

$$Y_{70}=0 \quad \text{Formula (105)}$$

$$\theta_{80}=\pi/(n+1) \quad \text{Formula (106)}$$

where,

X axis: a straight line extending through the center of the outer rotor,

Y axis: a straight line perpendicular to the X axis and extending through the center of the outer rotor, (X70, Y70): coordinates of the center of the arc forming the root portion, (Xso, Yso): coordinates of the center of the arc forming the addendum portion, r7o: the radius of the arc forming the root portion, no: the radius of the arc forming the addendum portion, 0 so: an angle formed between the straight line extending through the center of the arc forming the addendum portion and the center of the outer rotor and the straight line extending through the center of the arc forming the root portion and the center of the outer rotor, $$R_{71}=(X_{71}^2+Y_{71}^2)^{1/2} \quad \text{Formula (107)}$$

$$\theta_{71}=\arccos(X_{71}/R_{71}) \quad \text{Formula (108)}$$

$$X_{72}=\{(R_{71}-R_{D3})\times\beta_{70}+R_{D3}\}\times\cos\theta_{71} \quad \text{Formula (109)}$$

$$Y_{72}=\{(R_{71}-R_{D3})\times\beta_{70}+R_{D3}\}\times\sin\theta_{71} \quad \text{Formula (110)}$$

where, (X71, Y71): coordinates of the point on the arc forming the addendum portion, R71: a distance from the center of the outer rotor to the coordinates (X71, Y71), 0 71. an angle formed between the X axis and the straight line extending through the center of the outer rotor and the coordinates (X71, Y71), (X72, Y72): the coordinates of the addendum profile after the modification, 13 70: a correction factor for modification.

$$R_{81}=(X_{81}^2+Y_{81}^2)^{1/2} \quad \text{Formula (111)}$$

$$\theta_{81}=\arccos(X_{81}/R_{81}) \quad \text{Formula (112)}$$

$$X_{82}=\{R_{D4}-(R_{D4}-R_{81})\times\beta_{80}\}\times\cos\theta_{81} \quad \text{Formula (113)}$$

$$Y_{82}=\{R_{D4}-(R_{D4}-R_{81})\times\beta_{80}\}\times\sin\theta_{81} \quad \text{Formula (114)}$$

where, (X81, Y81): coordinates of the point on the arc forming the addendum portion, R81: a distance from the center of the outer rotor to the coordinates (X81, Y81), 0 81: an angle formed between the X axis and the straight line extending through the center of the outer rotor and the coordinates (X81, Y81), (X82, Y82): the coordinates of the addendum profile after the modification, 13 80: a correction factor for modification.

$$e_{50}=[\{(R_{A1}-R_{D1})\times\beta_{50}+R_{D1}\}-\{R_{D2}-(R_{D2}-R_{A2})\times\beta_{60}\}]/2+d_{50} \quad \text{Formula (115)}$$

$$R_{B1}'=\tfrac{3}{2}[\{R_{A1}-R_{D1}\}\times\beta_{50}+R_{D1}]-\tfrac{1}{2}\times\{R_{D2}-(R_{D2}-R_{A2})\times\beta_{60}\}+d_{60} \quad \text{Formula (116)}$$

$$R_{B2}'=[\{(R_{A1}-R_{D1})\times\beta_{50}+R_{D1}\}+\{R_{D2}-(R_{D2}-R_{A2})\times\beta_{60}\}]/2+d_{70} \quad \text{Formula (117)}$$

where, e5o: a distance between the center of the inner rotor and the center of the outer rotor (eccentricity amount), RBI': the radius of the root circle of the outer rotor after the modification, RB2': the radius of the addendum circle of the outer rotor after the modification, and d5o, dso, d7o: correction amounts for allowing outer rotor rotation with clearance.

According to a tenth technical means, an oil pump rotor for use in an oil pump including an inner rotor having (n: "n" is a natural number) external teeth, an outer rotor having (n+1) internal teeth meshing with the external teeth, and a casing forming a suction port for drawing a fluid and a discharge port for discharging the fluid, such that in association with rotation of the inner rotor, the external teeth thereof mesh with the internal teeth of the outer rotor, thus rotating this outer rotor and the fluid is drawn/discharged to be conveyed according to volume changes of cells formed between teeth faces of the two rotors;

wherein a tooth addendum profile of the inner rotor comprises a modification, based on Formulas (201), (203), of a first epicycloid curve generated by a first epicycloid (E1) rolling, without slipping, around outside a basic circle (E) thereof;

a tooth root profile of the inner rotor comprises a modification, based on Formulas (201), (203), of a first hypocycloid curve generated by a first hypocycloid (E2) rolling without slipping, around inside said basic circle (E) thereof a tooth root profile of the outer rotor comprises a modification, based on Formulas (202), (203), of a second epicycloid curve generated by a second epicycloid (F1) rolling, without slipping, around outside a basic circle (F) thereof and a tooth addendum profile of the outer rotor comprises a modification, based on Formulas (202), (203), of a second hypocycloid curve generated by a second hypocycloid (F2) rolling, without slipping, around inside said basic circle (F) thereof.

0E=n X(0E1 X a1+0E2 X a2)

$$\phi E=n\times(\phi E1\times\alpha 1+\phi E2\times\alpha 2) \quad \text{Formula (201)}$$

$$\phi F=(n+1)\times(\phi F1\times\beta 1+\phi F2\times\beta 2) \quad \text{Formula (202)}$$

$$\phi E1+\phi E2+H1=\phi F1+\phi F2+H2=2C \quad \text{Formula (203)}$$

In the above Formulas (201), (202) and (203);

ϕE: the diameter of the basic circle E of the inner rotor,

ϕE1: the diameter of the first epicycloid E1,

ϕE2: the diameter of the first hypocycloid E2,

ϕF: the diameter of the basic circle F of the outer rotor,

ϕF1: the diameter of the second epicycloid F1,

ϕF2: the diameter of the second hypocycloid F2,

C: an eccentricity amount between the inner rotor and the outer rotor,

α1: a correction factor for the epicycloid ϕE1,

α2: a correction factor for the hypocycloid ϕE2,

β1: a correction factor for the epicycloid ϕF1,

β2: a correction factor for the hypocycloid ϕF2, and

H1, H2: correction factors for the eccentricity amount C, where $0<\alpha 1<1$;

$0<\alpha 2<1$;

$0<\beta 1<1$;

$0<\beta 2<1$;

$-1<H1<1$;

$-1<H2<1$.

Effects of the Invention

According to the invention of claims 1 and 2, an oil pump rotor for use in an oil pump including an inner rotor having (n: "n" is a natural number) external teeth, an outer rotor having (n+1) internal teeth meshing with the external teeth, and a casing forming a suction port for drawing a fluid and a discharge port for discharging the fluid, such that in association with meshing and co-rotation of the inner and outer rotors, the fluid is drawn/discharged to be conveyed according to volume changes of cells formed between teeth faces of the two rotors;

wherein, for a tooth profile formed of a mathematical curve and having a tooth addendum circle A1 with a radius Rai and a tooth root curve A2 with a radius RA2, a circle D1 has a radius RD1 which satisfies Formula (1) and a circle $_{D2}$ has a radius $R_{D2}$ which satisfies both Formula (2) and Formula (3), $$R_{A1}>R_{D1}>R_{A2} \quad \text{Formula (1)}$$

$$R_{A1}>R_{D2}>R_{A2} \quad \text{Formula (2)}$$

$$R_{D1}\geq R_{D2} \quad \text{Formula (3)}$$

a tooth profile of the external teeth of the inner rotor comprises at least either one of a modification, in a radially outer direction, of said tooth profile, on the outer side of said circle D1 and a modification, in a radially inner direction, of said tooth profile, on the inner side of said circle $_{D2}$. With this, it is possible to increase the discharge amount of the oil pump, without decreasing the number of teeth.

According to the invention of claim 3, for the inner rotor formed of the well-known cycloid curve, if the modification is made on the outer side of the circle D1, the tooth profile is modified in the radially outer direction. Whereas, if the modification is made on the inner side of the circle D1, the tooth profile is modified in the radially inner direction. With this, it is possible to increase the discharge amount of the oil pump, without decreasing the number of teeth.

According to the invention of claim 4, for the inner rotor formed of an envelope of a family of arcs having centers on the well-known trochoid curve, if the outer side of the circle D1 is modified, the tooth profile is modified in the radially outer direction. Whereas, if the inner side of the circle D1 is modified, the tooth profile is modified on the radially inner direction. With this, it is possible to increase the discharge amount of the oil pump, without decreasing the number of teeth.

According to the invention of claim 5, for the inner rotor formed of an arcuate curve represented by two arcs having an addendum portion and a root portion tangent to each other, if the outer side of the circle D1 is modified, the tooth profile is modified in the radially outer direction. Whereas, if the inner side of the circle D1 is modified, the tooth profile is modified on the radially inner direction. With this, it is possible to increase the discharge amount of the oil pump, without decreasing the number of teeth.

According to the invention of claim 6, the outer rotor meshing with the inner rotor has a tooth profile formed by a method comprising the steps of revolving the inner rotor in a direction on a perimeter of a circle (D) at an angular velocity (co), said circle (D) having a center offset from the center of the inner rotor by a predetermined distance (e) and having a radius (e) equal to said predetermined distance;

rotating, at the same time, the inner rotor on its own axis in the direction opposite to said direction of revolution at an angular velocity (co/n) which is 1/n times said angular velocity (co) of the revolution, thereby forming an envelope;

providing, as a 0-revolution angle direction, an angle as seen at the time of the start of the revolution from the center of said circle (D) toward the center of the inner rotor;

modifying vicinity of an intersection between said envelope and an axis along said 0-revolution angle direction toward a radially outer side, modifying vicinity of an intersection between said envelope and an axis along a it/(n+1) revolution angle direction of the inner rotor toward a radially outer side by an amount smaller than or equal to the amount of said radially outer modification of the vicinity of the intersection with the 0-revolution angle axis;

extracting a portion of said envelope contained in an angular area greater than 0-revolution angle and less than 7r/(n+1) revolution angle, as a partial envelope;

rotating said partial envelope by a small angle (a) along the revolution direction about the center of said circle (D), removing a further portion of said envelope extending out of said angular area and connecting, to said removed portion, a gap formed between said partial envelope and said 0-revolution angle axis, thereby forming a corrected partial envelope;

copying said corrected partial envelope in line symmetry relative to said 0-revolution angle axis, thereby forming a partial tooth profile; and copying said partial tooth profile by rotating it about the center of said circle (D) for a plurality of times for an angle: 2 7r/(n+1) for each time, thereby forming the tooth profile of the outer rotor. This construction allows smooth engagement and rotation with the modified inner rotor.

According to the invention of claim 7, the outer rotor meshing with the inner rotor has an internal tooth profile formed by the well-known cycloid curve having a root circle B1 with a radius RB1 and an addendum circle B2 with a radius RB2, if the outer side of a circle D3 having a radius RD3 satisfying:

RB1>RD3>RB2 is modified, the root profile is modified in the radially outer direction, whereas, if the inner side of a circle D4 having a radius RD4 satisfying:

RB1>RD4>RB2 RD3≥RD4 is modified, the addendum profile is modified in the radially inner direction and the relationship formulas relative to the inner rotor are satisfied This construction allows smooth engagement and rotation with the modified inner rotor.

According to the invention of claim 8, the outer rotor meshing with the inner rotor has an internal tooth profile formed by an arcuate curve represented by two arcs having an addendum portion and a root portion tangent to each other, having a root circle B1 with a radius RBI and an addendum circle B2 with a radius RB2, if the outer side of a circle D3 having a radius RD3 satisfying:

RB1>RD3>RB2 is modified, the root profile is modified in the radially outer direction, whereas, if the inner side of a circle D4 having a radius RD4 satisfying:

RB1>RD4>RB2 RD3≥RD4 is modified, the addendum profile is modified in the radially inner direction and the relationship formulas relative to the inner rotor are satisfied This construction allows smooth engagement and rotation with the modified inner rotor.

According to the invention of claim 9, the internal tooth profile of the outer rotor meshing with the inner rotor has an internal tooth profile formed by an arcuate curve represented by two arcs having an addendum portion and a root portion tangent to each other, having a root circle B1 with a radius RBI and an addendum circle B2 with a radius RB2, if the outer side of a circle D3 having a radius RD3 satisfying:

RB1>RD3>RB2 is modified, the root profile is modified in the radially outer direction, whereas, if the inner side of a circle D4 having a radius RD4 satisfying:

RB1>RD4>RB2 RD3≥RD4 is modified, the addendum profile is modified in the radially inner direction and the relationship formulas relative to the inner rotor are satisfied This construction allows smooth engagement and rotation with the modified inner rotor.

According to the invention of claim 10, a tooth addendum profile of the inner rotor comprises a modification, based on Formulas (201), (203), of a first epicycloid curve generated by a first epicycloid (E1) rolling, without slipping, around outside a basic circle (E) thereof;

a tooth root profile of the inner rotor comprises a modification, based on Formulas (201), (203), of a first hypocycloid curve generated by a first hypocycloid (E2) rolling, without slipping, around inside said basic circle (E) thereof a tooth root profile of the outer rotor comprises a modification, based on Formulas (202), (203), of a second epicycloid curve generated by a second epicycloid (F1) rolling, without slipping, around outside a basic circle (F) thereof and a tooth addendum profile of the outer rotor comprises a modification, based on Formulas (202), (203), of a second hypocycloid curve generated by a second hypocycloid (F2) rolling, without slipping, around inside said basic circle (F) thereof. With this, it is possible to increase the discharge amount by increasing the number of teeth without enlarging the outer diameter and the width of the rotor, whereby a compact oil pump rotor having reduced ripple and noise can be provided.

$$\phi E = n \times (\phi E1 \times \alpha 1 + \phi E2 \times \alpha 2) \quad \text{Formula (201)}$$

$$\phi F = (n+1) \times (\phi F1 \times \beta 1 \phi F2 \times \beta 2) \quad \text{Formula (202)}$$

$$\phi E1 + \phi E2 + H1 = \phi F1 + \phi F2 + H2 = 2C \quad \text{Formula (203)}$$

In the above Formulas (201), (202) and (208);

ϕE: the diameter of the basic circle E of the inner rotor,

ϕE1: the diameter of the first epicycloid E1,

ϕE2: the diameter of the first hypocycloid E2,

ϕF: the diameter of the basic circle F of the outer rotor,

ϕF1: the diameter of the second epicycloid F1,

ϕF2: the diameter of the second hypocycloid

C: an eccentricity amount between the inner rotor and the outer rotor,

α1: a correction factor for the epicycloid ϕE1,

α2: a correction factor for the hypocycloid ϕE2,

β1: a correction factor for the epicycloid ϕF1,

β2: a correction factor for the hypocycloid ϕF2, and

H1, H2: correction factors for the eccentricity amount C.

BEST MODE OF EMBODYING THE INVENTION

[First Embodiment]

A first embodiment of an oil pump rotor relating to the present invention will be described with reference to FIGS. 1 through 6.

An oil pump shown in FIG. 1 illustrates an embodiment which comprises modifications of a cycloid curve. The oil pump includes an inner rotor 10 having 6 (six) external teeth 11, an outer rotor 20 having 7 (seven) internal teeth 21 meshing with the external teeth 11 of the inner rotor 10, and a casing 50 having a suction port 40 for drawing a fluid and a discharge port 41 for discharging the fluid In operation, as the two rotors are meshed with each other and rotated in unison, in association with changes in volumes of cells 30 formed between the teeth of the two rotors, the fluid is drawn/discharge to be conveyed.

FIG. 2 shows shapes or profiles of the inner rotor 10 before and after modifications. First, a tooth profile Si formed of the well-known cycloid curve has an addendum circle A1 and a root circle A2. A circle D1 has a diameter which is smaller than the addendum circle Ai and greater than the root circle A2. Then, portions of the shape, tooth profile, of the inner rotor 10 on the radially outer side of the circle D1 are modified, relative to this circle, toward the radially outer direction, whereas portions of the tooth profile on the radially inner side of the circle D1 are modified, relative to this circle, toward the radially inner direction.

FIG. 3 is an explanatory view for explaining a process of forming the inner rotor 10 of FIG. 2. In FIG. 3, (a) is an explanatory view of the addendum side and (b) is an explanatory view of the root side.

First, the cycloid curve constituting the tooth profile Si can be represented by using Formulas (4) through (8) below.

$$X_{10}=(R_A+R_{a1})\times\cos\theta_{10}-R_{a1}\times\cos[\{(R_A+R_{a1})/R_{a1}\}\times\theta_{10}] \quad \text{Formula (4)}$$

$$Y_{10}=(R_A+R_{a1})\times\sin\theta_{10}-R_{a1}\times\sin[\{(R_A+R_{a1})/R_{a1}\}\times\theta_{10}] \quad \text{Formula (5)}$$

$$X_{20}=(R_A-R_{a2})\times\cos\theta_{20}+R_{a2}\times\cos[\{(R_{a2}-R_A)/R_{a2}\}\times\theta_{20}] \quad \text{Formula (6)}$$

$$Y_{20}=(R_A-R_{a2})\times\sin\theta_{20}+R_{a2}\times\sin[\{(R_{a2}-R_A)/R_{a2}\}\times\theta_{20}] \quad \text{Formula (7);}$$

$$R_A=n\times(R_{a1}+R_{a2}) \quad \text{Formula (8)}$$

where

X axis: the straight line extending through the center of the inner rotor,

Y axis: the straight line perpendicular to the X axis and extending through the center of the inner rotor, in the Formulas (4) through (8);

RA: the radius of a basic circle of the cycloid curve,

Rai: the radius of an epicycloid of the cycloid curve,

Rae: the radius of a hypocycloid of the cycloid curve, 01o an angle formed between the X axis and a straight line extending through the center of the epicycloid and the center of the inner rotor, 0 20: an angle formed between the X axis and a straight line extending through the center of the hypocycloid and the center of the inner rotor, (Xio, Yio): coordinates of the cycloid curve formed by the epicycloid, and (X20, Y20): coordinates of the cycloid curve formed by the hypocycloid, That is, as shown in FIG. 3(*a*), as the epicycloid having the radius Rai makes one revolution on the basic circle having the radius RA from a point Pi as a start point, there is formed a cycloid curve P1Qi (a portion of the tooth profile Si). This constitutes one tooth tip of the inner rotor 10 before the modification. Then, as a hypocycloid having the radius Ra2 makes one revolution on the basic circle having the radius RA from the point Qi as the start point, there is formed a cycloid curve Q1Ri (a further portion of the tooth profile Si). This constitutes one tooth root of the inner rotor 10 before the modification. By repeating the above operations alternately, there is formed the tooth profile Si shown in FIG. 2 constituted from the well-known cycloid curve.

Then, this tooth profile Si is subjected to modifications as follows.

First, on the outer side of the circle Di (addendum side), as shown in FIG. 3(*a*), a curve formed by coordinates (X11, Y11) represented by Formulas (9) through (12) below is used as a modified addendum profile.

$$R_{11}=(X_{10}^2+Y_{10}^2)^{1/2} \quad \text{Formula (9)}$$

$$\theta_{11}=\arccos(X_{10}/R_{11}) \quad \text{Formula (10)}$$

$$X_{11}=\{(R_{11}-R_{D1})\times\beta_{10}+R_{D1}\}\times\cos\theta_{11} \quad \text{Formula (11)}$$

$$Y_{11}=\{(R_{11}-R_{D1})\times\beta_{10}+R_{D1}\}\times\sin\theta_{11} \quad \text{Formula (12)}$$

where,

R11: a distance from the inner rotor center to the coordinates (Xio, Y1o), 0 11: an angle formed between the X axis and the straight line extending through the inner rotor center and the coordinates (Xlo, Y1o), (X11, Y11): coordinates of the addendum profile after modification, and Q 1o: a correction factor for modification On the other hand, on the inner side (root side) of the circle D1, a curve formed by coordinates (X11, Yu) represented by Formulas (13) through (16) below is used as a modified root profile.

$$R_{21}=(X_{20}^2+Y_{20}^2)^{1/2} \quad \text{Formula (13)}$$

$$\theta_{21}=\arccos(X_{20}/R_{21}) \quad \text{Formula (14)}$$

$$X_{21}=\{R_{D2}-(R_{D2}-R_{21})\times\beta_{20}\}\times\cos\theta_{21} \quad \text{Formula (15)}$$

$$Y_{21}=\{R_{D2}-(R_{D2}-R_{21})\times\beta_{20}\}\times\sin\theta_{21} \quad \text{Formula (16)}$$

where,

R21: a distance from the inner rotor center to the coordinates (X20, Y2o), 0 21: an angle formed between the X axis and the straight line extending through the inner rotor center and the coordinates (X20, Y20), (X21, Y21): coordinates of the root profile after modification, and $ 20: a correction factor for modification.

Eventually, by effecting the above-described modifications on the tooth profile S1 constituted from the well-known cycloid curve, there can be formed the external tooth profile of the inner rotor 10 shown in FIG. 2.

Further, FIG. 4 shows shapes or profiles of the outer rotor 20 before/after modifications. Like the inner rotor 10 described above, a tooth profile S2 formed of the well-known cycloid curve has a root circle B1 and an addendum circle B2. A circle D3 has a diameter which is smaller than the root circle B1 and greater than the addendum circle B2. Then, portions of the shape, tooth profile, of the outer rotor on the radially outer side of the circle D3 are modified, relative to this circle, toward the radially outer direction. A further circle D4 has a diameter smaller than the circle D3 and greater than the addendum circle B2. Then, the portions of the tooth profile of the outer rotor on the radially inner side of the circle D4 are modified, relative to this circle, toward the radially inner direction.

FIG. 5 is an explanatory view for explaining a process of forming the outer rotor 20 of FIG. 4. In FIG. 5, (a) is an explanatory view of the addendum side and (b) is an explanatory view of the root side.

The modifications thereof are similar to those of the inner rotor, There are shown below formulas representing the cycloid curve constituting the tooth profile S2 and formulas used for modifying the tooth profile S2.

$$X_{30}=(R_B+R_{b1})\cos\theta_{30}-R_{b1}\times\cos[\{(R_B+R_{b1})/R_{b1}\}\times\theta_{30}] \quad \text{Formula (61)}$$

$$Y_{30}=(R_B+R_{b1})\sin\theta_{30}-R_{b1}\times\sin[\{(R_B+R_{b1})/R_{b1}\}\times\theta_{30}] \quad \text{Formula (62)}$$

$$X_{40}=(R_B-R_{b2})\cos\theta_{40}+R_{b2}\times\cos[\{(R_{b2}-R_B)/R_{b2}\}\times\theta_{40}] \quad \text{Formula (63)}$$

$$Y_{40}=(R_B-R_{b2})\sin\theta_{40}+R_{b2}\times\sin[\{(R_{b2}-R_B)/R_{b2}\}\times\theta_{40}] \quad \text{Formula (64)}$$

$$R_B=(n+1)\times(R_{b1}+R_{b2}) \quad \text{Formula (65)}$$

where,

X axis: a straight line extending through the center 02 of the outer rotor,

Y axis: a straight line perpendicular to the X axis and extending through the center 02 of the outer rotor, in Formulas (61) through (65), RB: the radius of a basic circle of the cycloid curve, Rb1: the radius of an epicycloid of the cycloid curve, Rb2: the radius of a hypocycloid of the cycloid curve, 0 30: an angle formed between the X axis and a straight line extending through the center of the epicycloid and the center of the outer rotor, 0 40: an angle formed between the X axis and a straight line extending through the center of the hypocycloid and the center of the outer rotor, (X30, Y30): coordinates of the cycloid curve formed by the epicycloid, and (X40, Y40): coordinates of the cycloid curve formed by the hypocycloid, Then, this tooth profile S2 is subjected to following modifications to form the internal tooth profile of the outer rotor 20.

First, on the outer side of the circle D3 (root side), as shown in FIG. 5(*a*), a curve represented by Formulas (66) through (69) below is used as a modified root profile.

$$R_{31}=(X_{30}^2+Y_{30}^2)^{1/2} \quad \text{Formula (66)}$$

$$\theta_{31}=\arccos(X_{30}/R_{31}) \quad \text{Formula (67)}$$

$$X_{31}=\{(R_{31}-R_{D3})\times\beta_{30}+R_{D3}\}\times\cos\theta_{31} \quad \text{Formula (68)}$$

$$Y_{31}=\{(R_{31}-R_{D3})\times\beta_{30}+R_{D3}\}\times\sin\theta_{31} \quad \text{Formula (69)}$$

where,

R31: a distance from the outer rotor center 02 to the coordinates (X30, Y30), 0 31: an angle formed between the X axis and the straight line extending through the outer rotor center 02 and the coordinates (X30, Y30), (X31, Y31): coordinates of the root profile after modification, and 1330: a correction factor for modification On the inner side (addendum side) on the circle D4, as shown in FIG. 5(*b*), a curve represented by Formulas (70) through (73) below is used as a modified root profile.

$$R_{41}=(X_{40}^2+Y_{40}^2)^{1/2} \quad \text{Formula (70)}$$

$$\theta_{41}=\arccos(X_{40}/R_{41}) \quad \text{Formula (71)}$$

$$X_{41}=\{R_{D4}-(R_{D4}-R_{41})\times\beta_{40}\}\times\cos\theta_{41} \quad \text{Formula (72)}$$

$$Y_{41}=\{R_{D4}-(R_{D4}-R_{41})\times\beta_{40}\}\times\sin\theta_{41} \quad \text{Formula (73)}$$

where,

R41: a distance from the outer rotor center 02 to the coordinates (X40, Y40), 0 41: an angle formed between the X axis and the straight line extending through the outer rotor center 02 and the coordinates (X40, Y40), (X41, Y41): coordinates of the addendum profile after modification, and 1340: a correction factor for modification Incidentally, the above-described formulas for forming the internal tooth profile of the outer rotor 20 satisfy the following Formulas (74) through (76), relative to the inner rotor 10.

$$e_{10}=[\{(R_A+2\times R_{a1})-R_{D1}\}\times\beta_{10}+R_{D1}]-[R_{D2}-\{R_{D2}-(R_A-2\times R_{a2})\}\times\beta_{20}]/2+d_{10} \quad \text{Formula (74)}$$

$$R_{B10}'=3/2\times\{(R_A+2\times R_{a1})-R_{D1}\}\times\beta_{10}+R_{D1}]-1/2\times[R_{D2}-\{R_{D2}-(R_A-2\times R_{a2})\}\times\beta_{20}]+d_{20} \quad \text{Formula (75)}$$

$$R_{B20}'=[\{(R_A+2\times R_{a1})-R_{D1}\}\times\beta_{10}+R_{D1}]+[R_{D2}-\{R_{D2}-(R_A-2\times R_{a2})\}\times\beta_{20}\}]/2+d_{30} \quad \text{Formula (76)}$$

where, elo: a distance between the center 01 of the inner rotor and the center 02 of the outer rotor (eccentricity amount), Rs1o': the radius of the root circle of the outer rotor after the modification, Rs20': the radius of the addendum circle of the outer rotor after the modification, and rho, d2o, d30: correction amounts for allowing outer rotor rotation with clearance.

FIG. 6(*a*) shows an oil pump comprising an inner rotor 10 and an outer rotor 20 which are constituted from the well-known cycloid curves. Whereas, FIG. 6(*b*) shows the oil pump comprising the inner rotor 10 and the outer rotor 20 which are modified by applying the present invention.

[Second Embodiment]

A second embodiment of the oil pump rotor relating to the present invention will be described with reference to FIGS. 7 through 11.

An oil pump shown in FIG. 7 has a tooth profile comprising modifications of a tooth profile formed by an envelope of a family of arcs having centers on the well-known trochoid curve. The oil pump includes an inner rotor 10 having 4 (four) external teeth 11, an outer rotor 20 having 5 (five) internal teeth 21 meshing with the external teeth 11 of the inner rotor 10, and a casing 50 having a suction port 40 for drawing a fluid and a discharge port 41 for discharging the fluid In operation, as the two rotors are meshed with each other and rotated in unison, in association with changes in volumes of cells 30 formed between the teeth of the two rotors, the fluid is drawn/discharge to be conveyed.

FIG. 8 shows shapes, tooth profiles, of the inner rotor before and after modification. Specifically, first, a tooth profile S1 is formed of an envelope of a family of arcs having centers on a well-known trochoid curve, the tooth profile S1 having an addendum circle A1 and a root circle A2. A circle D1 has a diameter smaller than the addendum circle A1 and greater than the root circle A2. A further circle $_{D2}$ has a diameter smaller than the circle D1 and greater than the root circle A2. Then, the portions of the tooth profile Si on the outer side of the circle D1 are modified toward the radially outer direction. Whereas, the portions of the tooth profile S1 on the inner side of the circle $_{D2}$ are modified toward the radially inner direction.

FIG. 9 is an explanatory view for explaining the process of forming the inner rotor 10 of FIG. 8. FIG. 9(*a*) is an explanatory view regarding the envelope of the family of arcs having centers on the well-known trochoid curve, which envelope forms the tooth profile Si. FIG. 9(*b*) is an explanatory view regarding the modifications of this tooth profile Si.

In FIG. 9(*a*), the envelope of the family of arcs having centers on the well-known trochoid curve, which envelopes forms the tooth profile Si, is represented by the following Formulas (21) through (26).

$$X_{100}=(R_H+R_I)\times\cos\theta_{100}-e_K\times\cos\theta_{101} \quad \text{Formula (21)}$$

$$Y_{100}=(R_H+R_I)\times\sin\theta_{100}-e_K\times\sin\theta_{101} \quad \text{Formula (22)}$$

$$\theta_{101}=(n+1)\times\theta_{100} \quad \text{Formula (23)}$$

$$R_H=n\times R_1 \quad \text{Formula (24)}$$

$$X_{101}=X_{100}\pm R_J/\{1+(dX_{100}/dY_{100})^2\}^{1/2} \quad \text{Formula (25)}$$

$$Y_{101}=X_{100}\pm R_J/\{1+(dX_{100}/dY_{100})^2\}^{1/2} \quad \text{Formula (26)}$$

where,

X axis: the straight line extending through the center of the inner rotor,

Y axis: the straight line perpendicular to the X axis and extending through the center of the inner rotor, (Xloo, Yloo): coordinates on the trochoid curve, RH: the radius of a basic circle of the trochoid curve, RI: the radius of a trochoid curve generating circle, ex: a distance between the center OT of the trochoid curve generating circle and a point generating the trochoid curve, 0 loo an angle formed between the X axis and a straight line extending through the center OT of the trochoid curve generating circle and the inner rotor center O1, 0101: an angle formed between the X axis and a straight line extending through the center O T of the trochoid curve generating circle and the trochoid curve generating point, (Xlol, Ylo): coordinates on the envelope, and RJ: the radius of the arcs E forming the envelope.

Further, as shown in FIG. 9(*b*), the formulas used for the modifications of this tooth profile Si are represented by the following Formulas (27) through (30) for the modification of the addendum profile awl the following Formulas (31) through (34) for the modification of the root profile, respectively.

$$R_{11}=(X_{101}^2+Y_{101}^2)^{1/2} \quad \text{Formula (27)}$$

$$\theta_{102}=\arccos(X_{101}/R_{11}) \quad \text{Formula (28)}$$

$$X_{102}=\{(R_{11}-R_{D1})\times\beta_{100}+R_{D1}\}\times\cos\theta_{102} \quad \text{Formula (29)}$$

$$Y_{102}=\{(R_{11}-R_{D1})\times\beta_{100}+R_{D1}\}\times\sin\theta_{102} \quad \text{Formula (30)}$$

where,

R11: a distance from the inner rotor center to the coordinates (X1o1, Y1o), 0102: an angle formed between the X axis and the straight line extending through the inner rotor center and the straight line extending through the coordinates (X1o1, Y1o1), (x102, Y102): coordinates of the addendum profile after modification, and /3 loo: a correction factor for modification $$R_{21}=(X_{101}^2+Y_{101}^2)^{1/2} \quad \text{Formula (31)}$$

$$\theta_{103}=\arccos(X_{101}/R_{21}) \quad \text{Formula (32)}$$

$$X_{103}=\{R_{D2}-(R_{D2}-R_{21})\times\beta_{101}\}\times\cos\theta_{103} \quad \text{Formula (33)}$$

$$Y_{103}=\{R_{D2}-(R_{D2}-R_{21})\times\beta_{101}\}\times\sin\theta_{103} \quad \text{Formula (34)}$$

where,

R21: a distance from the inner rotor center 01 to the coordinates (X101, Y1o1), 0103: an angle formed between the X axis and the straight line extending through the inner rotor center 01 and the straight line extending through the coordinates (X101, Y1o1), (X103, Y103): coordinates of the root profile after modification, and a 1o1: a correction factor for modification.

Further, FIG. 10 shows shapes, tooth profiles, of the outer rotor 20 before and after the modifications. Like the inner rotor 10 described above, specifically, first, a tooth profile S2 which has tooth tip portions and tooth root portions tangent to each other, is formed of an envelope of a family of arcs. A circle D3 has a diameter smaller than the root circle B1 and greater than the addendum circle B2. A further circle D4 has a diameter smaller than the circle $_{D2}$ and greater than the addendum circle B2. Then, the portions of the tooth profile S2 on the outer side of the circle D3 are modified toward the radially outer direction. Whereas, the portions of the tooth profile S2 on the inner side of the circle D4 are modified toward the radially inner direction.

FIG. 11 is an explanatory view illustrating the process of forming the outer rotor 20 of FIG. 10. FIG. 11(*a*) is an explanatory view regarding the arcuate curve constituting the tooth profile S2 and FIG. 11(*b*) is an explanatory view regarding the modification of this tooth profile S2.

In FIG. 11(*a*), the arcuate curve constituting the tooth profile S2 is represented by the following Formulas (81) through (84).

$$(X_{200}-X_{210})^2+(Y_{200}-Y_{210})^2=R_J^2 \quad \text{Formula (81)}$$

$$X_{210}^2+Y_{210}^2=R_L^2 \quad \text{Formula (82)}$$

$$X_{220}^2+Y_{220}^2=R_{B1}^2 \quad \text{Formula (83)}$$

$$R_{B1}=(3\times R_{A1}-R_{A2})/2+g_{10} \quad \text{Formula (84)},$$

where,

X axis: a straight line extending through the center 02 of the outer rotor,

Y axis: a straight line perpendicular to the X axis and extending through the outer rotor center 02, (X200, Y200): coordinates of an arc forming the addendum portion, (X210, Y210): coordinates of the center of the circle whose arc forms the addendum portion, (X220, Y220): coordinates of an arc of the addendum circle B1 forming the addendum portion, RI: a distance between the outer rotor center and the center of the circle forming whose arc forms the addendum portion, and RB1: a radius of the root circle B1 forming the root portion.

g1o: a correction amount for allowing outer rotor rotation with clearance.

Further, as shown in FIG. 11(*b*), the formulas used for the modifications of this tooth profile S2 are represented by the following Formula (85) for the modification of the root side and by the following Formulas (86) and (87) for the modification of the addendum side, respectively.

$$X_{230}^2+Y_{230}^2=R_{B1}'^2 \quad \text{Formula (85)}$$

where, (X230, Y230): coordinates of the root profile after the modification, and RB1': a radius of the arc forming the root portion after the modification.

$$X_{201}=(1-\beta_{200})\times R_{D4}\times\cos\theta_{200}+X_{200}\times\beta_{200}+g_{20} \quad \text{Formula (86)}$$

$$Y_{201}=(1-\beta_{200})\times R_{D4}\times\sin\theta_{200}+Y_{200}\times\beta_{200}+g_{30} \quad \text{Formula (87)}$$

where, (X201, Y201): coordinates of the addendum profile after the modification, 0 200: an angle formed between the X axis and the straight line extending through the outer rotor center 02 and the point (X200, Y200), a 200: a correction factor for modification, and gio, g2o, g3o: correction amounts for allowing outer rotor rotation with clearance.

[Third Embodiment]

A third embodiment of the oil pump rotor relating to the present invention will be described with reference to FIGS. 12 through 16.

An oil pump shown in FIG. 12 is an embodiment in the case of modifications of the addendum portion and the root portion being formed an arcuate curve represent by two arcs tangent to each other. The oil pump includes an inner rotor 10 having 8 (eight) external teeth 11, an outer rotor 20 having 9 (nine) internal teeth 21 meshing with the external teeth 11 of the inner rotor 10, and a casing 50 having a suction port 40 for drawing a fluid and a discharge port 41 for, discharging the fluid In operation, as the two rotors are meshed with each other and rotated in unison, in association with changes in volumes of cells 30 formed between the teeth of the two rotors, the fluid is drawn/discharge to be conveyed.

FIG. 13 shows shapes or profiles of the inner rotor 10 before and after modifications. The tooth profile Si comprises tooth tip portions and tooth root portions which are formed of an arcuate curve represented by two arcs tangent to each other. A circle Di has a diameter smaller than the addendum circle Ai and greater than the root circle A2. A further circle $_{D2}$ has a diameter smaller than the circle Di and greater than the root circle A2. Then, the portions of the tooth profile Si on the outer side of the circle Di are modified toward the radially outer direction. Whereas, the portions of the tooth profile Si on the inner side of the circle $_{D2}$ are modified toward the radially inner direction.

FIG. 14 is an explanatory view illustrating the process of forming the outer rotor 20 of FIG. 13. FIG. 14(*a*) is an explanatory view regarding the arcuate curve constituting the tooth profile Si and FIG. 14(*b*) is an explanatory view regarding the modification of this tooth profile Si.

In FIG. 14(*a*), the arcuate curve constituting the tooth profile Si is represented by the following Formulas (41) through (46).

$$(X_{50}-X_{60})^2+(Y_{50}-Y_{60})^2=(r_{50}+r_{60})^2 \quad \text{Formula (41)}$$

$$X_{60}=(R_{A2}+r_{60})\cos\theta_{60} \quad \text{Formula (42)}$$

$$Y_{60}=(R_{A2}+r_{60})\sin\theta_{60} \quad \text{Formula (43)}$$

$$X_{50}=R_{A1}-r_{60} \quad \text{Formula (44)}$$

$$Y_{50}=0 \quad \text{Formula (45)}$$

$$\theta_{60}=\pi/n \quad \text{Formula (46)}$$

where,

X axis: a straight line extending through the center 01 of the inner rotor,

Y axis: a straight line perpendicular to the X axis and extending through the center 01 of the inner rotor, (X50, Y50): coordinates of the center of the arc forming the tooth addendum portion, (X60, Y60): coordinates of the center of the arc forming the tooth root portion, r50: the radius of the arc forming the tooth addendum portion, no: the radius of the arc forming the tooth root portion, 0 60: an angle formed between the straight line extending through the center of the arc forming the tooth addendum portion and the center 01 of the inner rotor and the straight line extending through the center of the arc forming the tooth root portion and the center 01 of the inner rotor.

Further, in FIG. 14(*b*), the formulas used for the modifications of this tooth profile Si are represented by the following Formulas (47) through (50) for the modification of the addendum profile and the following Formulas (51) through (54) for the modification of the root profile, respectively.

$$R_{51}=(X_{51}^2+Y_{51}^2)^{1/2} \quad \text{Formula (47)}$$

$$\theta_{51}=\arccos(X_{51}/R_{51}) \quad \text{Formula (48)}$$

$$X_{52}=\{(R_{51}-R_{D1})\times\beta_{50}+R_{D1}\}\times\cos\theta_{51} \quad \text{Formula (49)}$$

$$Y_{52}=\{(R_{51}-R_{D1})\times\beta_{50}+R_{D1}\}\times\sin\theta_{51} \quad \text{Formula (50)}$$

where, (X51, Y51): coordinates of the points on the arc forming the tooth addendum portion, R51: a distance from the center of the inner rotor to the coordinates (X51, Y51), 0 51. an angle formed between the X axis and the straight line extending through the center of the inner rotor and the coordinates (X51, Y5J), (X52, Y52): the coordinates of the addendum profile after the modification, Q 50: a correction factor for modification.

$$R_{61}=(X_{61}^2+Y_{61}^2)^{1/2} \quad \text{Formula (51)}$$

$$\theta_{61}=\arccos(X_{61}/R_{61}) \quad \text{Formula (52)}$$

$$X_{62}=\{(R_{D2}-(R_{D2}-R_{61})\times\beta_{60}\}\times\cos\theta_{61} \quad \text{Formula (53)}$$

$$Y_{62}=\{(R_{D2}-(R_{D2}-R_{61})\times\beta_{60}\}\times\cos\theta_{61} \quad \text{Formula (54)}$$

where, (X61, Y61): coordinates of the points on the arc forming the root portion, R61: a distance from the center 01 of the inner rotor to the coordinates (X61, Y61), 0 61: an angle formed between the X axis and the straight line extending through the center 01 of the inner rotor and the coordinates (X61, Y61), (X62, Y62): the coordinates of the root profile after the modification, a 60: a correction factor for modification.

Further, FIG. 15 shows shapes, tooth profiles, of the outer rotor 20 before and after the modifications. Like the inner rotor 10 described above, specifically, first, a tooth profile S2 which has tooth tip portions and tooth root portions tangent to each other, is formed of an envelope of a family of arcs. A circle D3 has a diameter smaller than the root circle B1 and greater than the addendum circle B2. A further circle D4 has a diameter smaller than the circle $_{D2}$ and greater than the addendum circle B2. Then, the portions of the tooth profile S2 on the outer side of the circle D3 are modified toward the radially outer direction. Whereas, the portions of the tooth profile S2 on the inner side of the circle D4 are modified toward the radially inner direction.

FIG. 16 is an explanatory view illustrating the process of forming the outer rotor 20 of FIG. 15. FIG. 16(*a*) is an explanatory view regarding the arcuate curve constituting the tooth profile S2 and FIG. 16(*b*) is an explanatory view regarding the modification of this tooth profile S2.

In FIG. 16(*a*), the arcuate curve constituting the tooth profile S2 is represented by the following Formulas (101) through (106).

$$(X_{70}-Y_{80})^2+(Y_{70}-Y_{80})^2=(r_{70}+r_{80})^2 \quad \text{Formula (101)}$$

$$X_{80}=(R_{B2}+r_{80})\cos\theta_{80} \quad \text{Formula (102)}$$

$$Y_{80}=(R_{B2}+r_{80})\sin\theta_{80} \quad \text{Formula (103)}$$

$$X_{70}=R_{B1}-r_{70} \quad \text{Formula (104)}$$

$$Y_{70}=0 \quad \text{Formula (105)}$$

$$\theta_{80}=\pi/(n+1) \quad \text{Formula (106)}$$

where,

X axis: a straight line extending through the center 02 of the outer rotor,

Y axis: a straight line perpendicular to the X axis and extending through the center 02 of the outer rotor, (X70, Y70): coordinates of the center of the arc forming the root portion, (X80, Y80): coordinates of the center of the arc forming the addendum portion, r7o: the radius of the arc forming the root portion, r8o: the radius of the arc forming the addendum portion, 080: an angle formed between the straight line extending through the center of the arc forming the addendum portion and the center 02 of the outer rotor and the straight line extending through the center of the arc forming the root portion and the center 02 of the outer rotor.

Further, as shown in FIG. 16(*b*), the formulas used for the modifications of this tooth profile S2 are represented by the following Formulas (107) through (110) for the modification of the root side and by the following Formulas (111) through (114) for the modification of the addendum side, respectively.

$$R_{71}=(X_{71}^2+Y_{71}^2)^{1/2} \quad \text{Formula (107)}$$

$$\theta_{71}=\arccos(X_{71}/R_{71}) \quad \text{formula (108)}$$

$$X_{72}=\{(R_{71}-R_{D3})\times\eta_{70}+R_{D3}\}\times\cos\theta_{71} \quad \text{Formula (109)}$$

$$Y_{72}=\{(R_{71}-R_{D3})\times\eta_{70}+R_{D3}\}\times\sin\theta_{71} \quad \text{Formula (110)}$$

where, (X71, Y71): coordinates of the point on the arc forming the addendum portion, R71: a distance from the center 02 of the outer rotor to the coordinates (X71, Y71), 0 71: an angle formed between the X axis and the straight line extending through the center 02 of the outer rotor and the coordinates (X71, Y7), (X72, Y72): the coordinates of the addendum profile after the modification, a 70: a correction factor for modification.

$$R_{81}=(X_{81}^2+Y_{81}^2)^{1/2} \quad \text{Formula (111)}$$

$$\theta_{81}=\arccos(X_{81}/R_{81}) \quad \text{Formula (112)}$$

$$X_{82}=\{R_{D4}-(R_{D4}-R_{81})\times\beta_{80}\}\times\cos\theta_{81} \quad \text{Formula (113)}$$

$$Y_{82}=\{R_{D4}-(R_{D4}-R_{81})\times\beta_{80}\}\times\sin\theta_{81} \quad \text{Formula (114)}$$

where, (X81, Y8): coordinates of the point on the arc forming the addendum portion, Rsi: a distance from the center 02 of the outer rotor to the coordinates (X81, Y81), 0 81: an angle formed between the X axis and the straight line extending through the center 02 of the outer rotor and the coordinates (X81, Y8), (X82, Y82): the coordinates of the addendum profile after the modification, and $ 8o: a correction factor for modification.

Incidentally, the above formulas for forming the internal tooth profile of the outer rotor 20 satisfy the relationship of the following Formulas (115) through (117) relative to the inner rotor 10.

$$e_{50}=[\{(R_{A1}-R_{D1})\times\beta_{50}+R_{D1}\}-\{R_{D2}-(R_{D2}-R_{A2})\times\beta_{60}\}]/2+d_{50} \quad \text{Formula (115)}$$

$$R_{B1}'=3/2[\{R_{A1}-R_{D1}\}\times\beta_{50}+R_{D1}]-1/2\times\{R_{D2}-(R_{D2}-R_{A2})\times\beta_{60}\}+d_{60} \quad \text{Formula (116)}$$

$$R_{B2}'=[\{(R_{A1}-R_{D1})\times\beta_{50}+R_{D1}\}+\{R_{D2}-(R_{D2}-R_{A2})\times\beta_{60}\}]/2+d_{70} \quad \text{Formula (117)}$$

where, e5o: a distance between the center 01 of the inner rotor and the center 02 of the outer rotor (eccentricity amount), RB1': the radius of the root circle of the outer rotor after the modification, RB2': the radius of the addendum circle of the outer rotor after the modification, and d5o, dso, duo: correction amounts for allowing outer rotor rotation with clearance.

[Fourth Embodiment]

A fourth embodiment of the oil pump rotor relating to the present invention is shown in FIG. 17.

An oil pump shown in FIG. 17 includes an inner rotor 10 having 11 (eleven) external teeth 11, an outer rotor 20 having 10 (ten) internal teeth 21 meshing (engaging) with the external teeth 11 of the inner rotor 10, and a casing 50 having a suction port 40 for drawing a fluid and a discharge port 41 for discharging the fluid In operation, as the two rotors are meshed with each other and rotated in unison, in association with changes in volumes of cells 30 formed between the teeth of the two rotors, the fluid is drawn/discharge to be conveyed.

Incidentally, the inner rotor 10 according to this embodiment has a tooth profile comprised of a modified cycloid curve, like the first embodiment described above. However, this modification is provided in the inner radial direction (tooth root side) only, no modification being made in the outer radial direction (tooth top side).

FIG. 18 is an explanatory figure for explaining formation of the outer rotor 20 meshing suitably with this inner rotor 10.

As shown in FIG. 18(*a*), first, a straight line extending through the center 01 of the inner rotor 10 is set as the X axis and a straight line perpendicular to the X axis and extending through the center 01 of the inner rotor 10 is set as the Y axis. Further, coordinates (e, 0) are obtained as a position away from the center 01 of the inner rotor 10 by a predetermined distance (e) and a circle D is drawn as a circle centering about the coordinates (e, 0) with the radius (e).

First, the center 01 of the inner rotor 10 is revolved at an angular velocity (co) along the perimeter of this circle D and is rotated counter-clockwise about its own axis at an angular velocity (co/n) (n is the number of teeth of the inner rotor), whereby an envelope Zo can be formed as shown in FIG. 18(*a*). Incidentally, in FIG. 18, the angle of revolution is set so as to increase in its value with clockwise rotation, as an angle as viewed from the center (e, 0) of the circle D toward the center 01 of the inner rotor 10 at the time of start of revolution, that is, the negative side of the X axis being the 0-revolution angle direction.

Here, for this envelope Zo, at least a portion thereof adjacent the intersection between this envelope Zo and the axis of 0 revolution angle is modified toward the outer radial direction; and also, a further portion thereof adjacent the intersection between this envelope Zo and the axis of 0 revolution angle is modified toward the outer radial direction by a modification amount smaller than or equal to the radially outward modification provided adjacent the intersection between the envelope Zo and the axis of 0 revolution angle. In order to obtain a curve with these modifications, the following operations are carried out.

When the center 01 of the inner rotor 10 as being rotated about its own axis, is revolved along the perimeter of the circle D, while the revolution angle is between 0 and 01, the tooth profile of the inner rotor 10 is modified in the outer radial direction with an enlarging modification coefficient (31, and while the revolution angle is between 0 and 0.2, the tooth profile of the inner rotor 10 is modified in the outer radial direction with an enlarging modification coefficient a 2, where the value of the enlarging modification coefficient 3 2 is smaller than the value of the enlarging modification coefficient/31. These enlarging modification coefficients 31 and 13 2 correspond to the correction coefficient 81o in the first embodiment described above.

With the above operations, as shown in FIG. 18(*a*), when the inner rotor 10 is located at a position on the dot line Io, the modification is made in the radially outer direction with the enlarging modification coefficient 31. Whereas, when the inner rotor 10 is located at a position on the dot line I1, the modification is made in the radially outer direction with the enlarging modification coefficient Q 2. by an amount smaller than the modification with (31. Therefore, with the enveloped Z1 obtained in this case, as compared with the envelope Zo, the vicinity of the intersection with the 0 revolution angle axis is modified in the radially outer direction and the vicinity of the intersection with the 0 2 revolution angle axis is modified in the radially outer direction by the amount smaller than the modification of the vicinity of the intersection with the 0 revolution angle axis.

Next, as shown, in FIG. 18(*b*), of the enveloped Z1 thus obtained, a portion thereof included in an area W delimited as being greater than the revolution angle 0 and 0 2 (area between the 0 revolution angle axis and the 0 2 revolution angle axis) is extracted as a partial envelope PZ1.

Then, this extracted partial envelope PZ1 is rotated by a small angle a in. the revolution direction about the center (e, 0) of the circle D and a portion thereof extending out of the area W as the result of the rotation is cut out, to which there is connected a gap G formed between the partial envelope PZ1 and the 0 revolution angle axis, whereby a modified partial envelope MZ1 is obtained. Incidentally, in this embodiment, the gap G is connected by a straight line. Instead, this can be connected by a curve.

Further, this modified partial envelope MZ1 is copied in line symmetry relative to the 0 revolution angle axis, thereby forming a partial tooth profile PT. Then, by rotating and copying this partial tooth profile PT for a plurality of times from the center (e, 0) of the circle D at an angle of 2 it/(n+1) for each time, there is obtained the tooth profile of the outer rotor 20.

With the formation of the outer rotor using the envelope Z1 comprising the above-described modification of the envelope Zo, there is ensured an appropriate clearance between the inner rotor 10 and the outer rotor 20. Also, with the rotation of the partial envelope PZ1 at the small angle a, there can be obtained an appropriate backlash. With these, there can be obtained the outer rotor 20 which can mesh and rotate smoothly with the modified inner rotor 10.

Incidentally, in this embodiment, the outer rotor 20 is formed, with the number of teeth of the inner rotor: n=9, the addendum circle radius of the inner rotor: RA1=21.3 mm, the radius of basic circle D1 for the modification of the inner rotor: RD=20.3 mm, the angle of the change of the enlarging modification coefficient from 131 to (3 2: 0 1=90°, the angle of extracting the partial envelope PZ1 from the envelope Z1: 0 2=18°, the enlarging correction coefficients: 13 1=1.0715, 13 2=1.05, e=3.53 mm, and a=0.08°.

[Fifth Embodiment]

A fifth embodiment of the oil pump rotor relating to the present invention will be described with reference to FIGS. 19 and 20.

An oil pump shown in FIG. 19 includes an inner rotor 10 having n (n is a natural number, n=6 in this embodiment) external teeth 11, an outer rotor 20 having n+1 (7 in this embodiment) internal teeth 21 meshing with the external teeth 11 of the inner rotor 10, and a casing 50 having a suction port 40 for drawing a fluid and a discharge port 41 for discharging the fluid. In operation, as the two rotors are meshed with each other and rotated in unison, in association with changes in volumes of cells 30 formed between the teeth of the two rotors, the fluid is drawn/discharge to be conveyed. Thee inner rotor 10 and the outer rotor 20 are accommodated within the casing 50.

Between the teeth of the inner rotor 10 and the teeth of the outer rotor 20, there are formed cells 30 along the rotational direction of the inner and outer rotors 10, 20. Each cell 30 is partitioned, on the forward and rearward sides thereof in the rotational direction of the two rotors 10, 20, as the external tooth 11 of the inner rotor 10 and the internal tooth 21 of the outer rotor 20 are in contact with each other. Further, on opposed lateral sides of the cell, the cell is partitioned by the presence of the casing 50. With these, the cell forms a fluid conveying chamber. Then, in association with rotations of the two rotors 10, 20, the volume of the cell alternately increases/decreases in repetition, with one rotation being one cycle.

The inner rotor 10 is mounted on a rotational shaft to be rotatable about the axis Oi. The addendum tooth profile of the inner rotor 10 is formed by modifying, based on the following Formulas (201), (203), a first epicycloid curve generated by a first epicycloid E1 rolling, without slipping, around outside the basic circle E of the inner rotor 10. The root tooth profile of the inner rotor 10 is formed by modifying, based on the following Formulas (201), 203), a hypocycloid curve generated by a first hypocycloid E2 rolling, without slipping, around inside the basic circle E of the inner rotor 10.

The outer rotor 20 is mounted with an offset (eccentricity amount: 0) relative to the axis O1 of the inner rotor 10 and supported within the housing 50 to be rotatable about the axis 02. The addendum tooth profile of the outer rotor 20 is formed by modifying, based on the following Formulas (201), (203), a first epicycloid curve generated by a second epicycloid F1 rolling, without slipping, around outside the basic circle F of the outer rotor 20. The root tooth profile of the outer rotor 20 is formed by modifying, based on the following Formulas (202), (203), a hypocycloid curve generated by a second hypocycloid F2 rolling, without slipping, around inside the basic circle F of the outer rotor 20.

$$\phi E=n\times(\phi E1\times\alpha 1+\phi E2\times\alpha 2) \quad \text{Formula (201)}$$

$$\phi F=(n+1)\times(\phi F1\times\beta 1+\phi F2\times\beta 2) \quad \text{Formula (202)}$$

$$\phi E1+\phi E2+H1=\phi F1+\phi F2+H2=2C \quad \text{Formula (203)}$$

In the above Formulas (201), (202) and (203);

ϕE: the diameter of the basic circle E of the inner rotor 10,

ϕE1: the diameter of the first epicycloid E1,

ϕE2: the diameter of the first hypocycloid E2,

ϕF: the diameter of the basic circle F of the outer rotor 20,

ϕF1: the diameter of the second epicycloid F1,

ϕF2: the diameter of the second hypocycloid F2,

C: an eccentricity amount between the inner rotor 10 and the outer rotor 20, α1: a correction factor for the epicycloid E1, α2: a correction factor for the hypocycloid E2

β1: a correction factor for the epicycloid F1,

β2: a correction factor for the hypocycloid F2, and

H1, H2: correction factors for the eccentricity amount C.

The above construction will be described with reference to FIG. 20. A first epicycloid curve U1 is formed by the first epicycloid E1. Then, this first epicycloid curve U1 is rotated for one rotation from the X axis to reach an end point. Then, this end point is connected with the axis Oi with a straight line Vi (which forms an angle 0 vi relative to the X axis). Then, this epicycloid curve U1 is subjected to a contraction modification from Vi to V1' (the angle formed between the straight line V1' and the X axis: 0 vi'<0 with maintaining constant the distance between the basic circle E and the addendum circle of the radius Ai, thereby forming a modified epicycloid curve Ui'.

Similarly, for a hypocycloid curve U2, V2 is a straight line (forming an angle of 0, 2 with the X axis) connecting the end point of this hypocycloid curve U2 and the axis Oi. Then, this hypocycloid curve U2 is subjected to a contraction modification from V2 to V2 (the angle formed between the straight line V2' and the X axis: 002'<0, 2), with maintaining constant the distance between the basic circle E and the addendum circle of the radius A1, thereby forming a modified hypocycloid curve U2'.

In the above, the explanation has been given for the case of the inner rotor 10. The process is similar in the case of the outer rotor 20 also. By effecting this modification of each cycloid curve, the addendum tooth profile and the root tooth profile are modified.

Here, for the inner rotor 10, it is required that the correction rolling distances of the first epicycloid E1 and the first hypocycloid E2 be complete each other with one rotation. That is, the sum of the correction rolling distances of the first epicycloid E1 and the first hypocycloid E2 need to be equal to the perimeter of the basic circle E. Hence, $$\pi\times\phi E=n(\pi\times\phi E1\times\alpha1+\pi\times\phi E2\times\alpha2),$$

that is:

$$\phi E=n\times(\phi E1\times\alpha1+\phi E2\times\alpha2) \qquad \text{Formula (201)}$$

Similarly, for the outer rotor 20, the sum of the correction rolling distances of the first epicycloid F1 and the first hypocycloid F2 need to be equal to the perimeter of the basic circle F. Hence, $$\pi\times\phi F=(n+1)\times(\pi\times\phi F1\times\beta1+\pi\times\phi F2\times\beta2),$$

that is;

$$\phi F=(n+1)\times(\phi F1\times\beta1+\phi F2\times\beta2) \qquad \text{Formula (202)}$$

Further, as the inner rotor 10 and the outer rotor 20 are to mesh each other, it is required that one of the following conditions be satisfied:

$$\phi E1+\phi E2=2C \text{ or } \phi F1+\phi F2=2C.$$

Moreover, in order to allow the inner rotor 10 to be rotated smoothly inside the outer rotor 20 and to reduce meshing resistance while keeping chip clearance and appropriate amount of backlash, and in order to avoid contact between the basic circle E of the inner rotor 10 and the basic circle F of the outer rotor 20 at the meshing position between the inner rotor 10 and the outer rotor 20, with using the correction coefficients H1 and H2 of the eccentricity amounts C of the inner rotor 10 and the outer rotor 20, the following relationship must be satisfied.

$$\phi E1+\phi E2+H1=\phi F1+\phi F2+H2=2C \qquad \text{Formula (203)}$$

Here, the correction coefficients a 1, a 2, (31, /3 2 and the correction coefficients H1 and 112 will be appropriately adjusted within the following ranges so as to set the clearance between the inner rotor and the outer rotor to a predetermined value.

$0<\alpha1, \alpha2, \beta1, \beta2<1$ $-1<H1, H2<1.$

Incidentally, in the present embodiment, the inner rotor 10 (basic circle E: c E=24.0000 mm, the first epicycloid E1: 4) E1=3.0000 mm, the first hypocycloid: E2=2.7778 mm, the number of teeth: n=6, the correction coefficients: a 1=0.7500, a 2=0.6300) and the outer rotor 20 (outer diameter: 4) 40.0 mm, basic circle: 4) F=29.8778 mm, the first epicycloid F1: 4) F1=3.0571 mm, the first hypocycloid: F2: F2=2.7178 mm, the correction coefficients: 13 1=0.8650, (3 2=0.5975, 111=0.0000, 112=0.0029) are assembled with the eccentricity amount: C=28.8889 mm, to together constitute an oil pump rotor.

In the casing 50, there is formed an arcuate suction port 40 along the cells 30 which are in the volume-increasing process, of the cells 30 formed between the teeth of the two rotors 10, 20 and there is also formed an arcuate discharge port 41 along the cells 30 which are in the volume-decreasing process.

In the course of meshing between the external teeth 11 and the internal teeth 21, after the condition of the minimum volume, the cells 30 are increased in their volumes in the course of movement thereof along the suction port. After the condition of the maximum volume, the cells 30 are decreased in their volumes in the course of movement thereof along the discharge port.

[Other Embodiments]

In the first through third embodiments described above, both the tooth addendum (chip) side and the tooth root side of the inner rotor 10 and the outer rotor 20 are modified. Instead, only one of the tooth addendum side and tooth root side of the inner rotor may be modified and the outer rotor too may be modified in accordance therewith. Further, in the case of the fourth embodiment described above, only the tooth root side of the inner rotor 10 is modified. Instead, the tooth addendum side thereof or both of the tooth addendum side and the tooth root side thereof may be modified.

In any one of the above-described embodiments, by modifying the outer rotor 20 in accordance with modification in the inner rotor 10, the volume of the cells is increased and the discharge amount of the oil pump too is increased correspondingly.

INDUSTRIAL APPLICABILITY

The present invention can be used as a lubricant oil pump for a motorcar, an automatic speed change oil pump for a motorcar, etc.

DESCRIPTION OF REFERENCE MARKS

Figure 1:
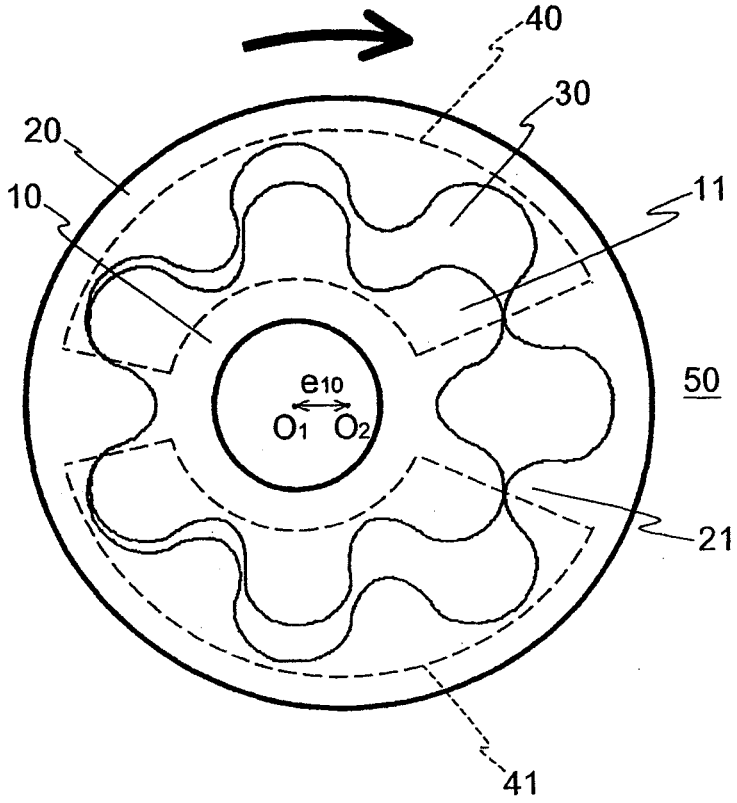
[FIG. 1] a plan view of a first embodiment of the oil pump according to the present invention.
Figure 2:
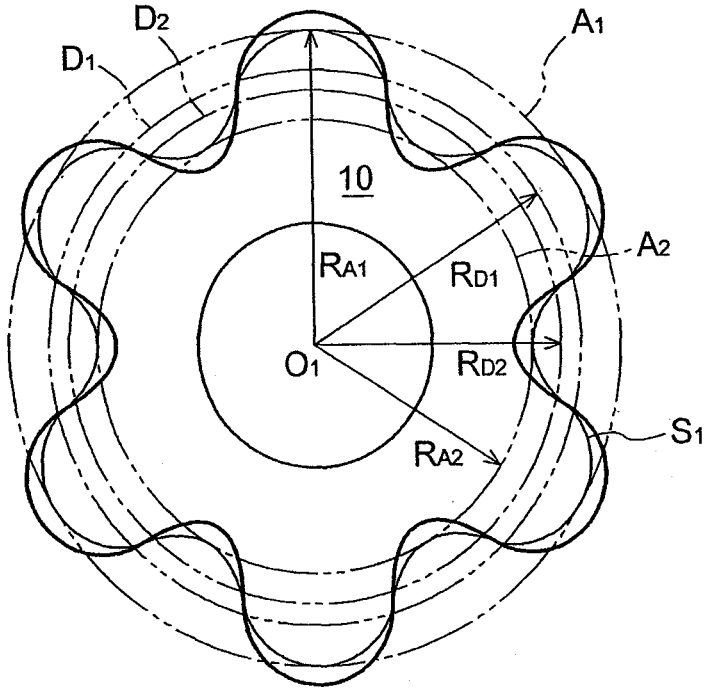
[FIG. 2] a plan view of an inner rotor relating to the first embodiment.
Figure 3:
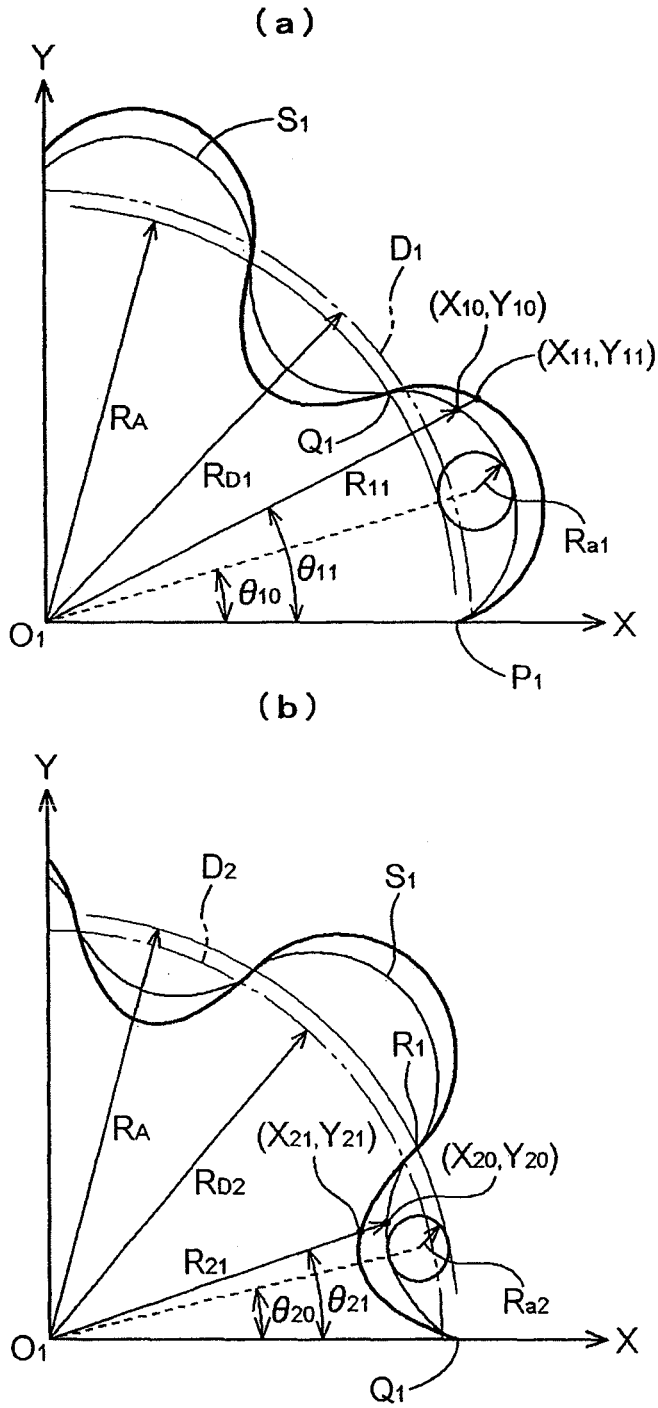
[FIG. 3] an explanatory view for forming the inner rotor relating to the first embodiment.
Figure 4:
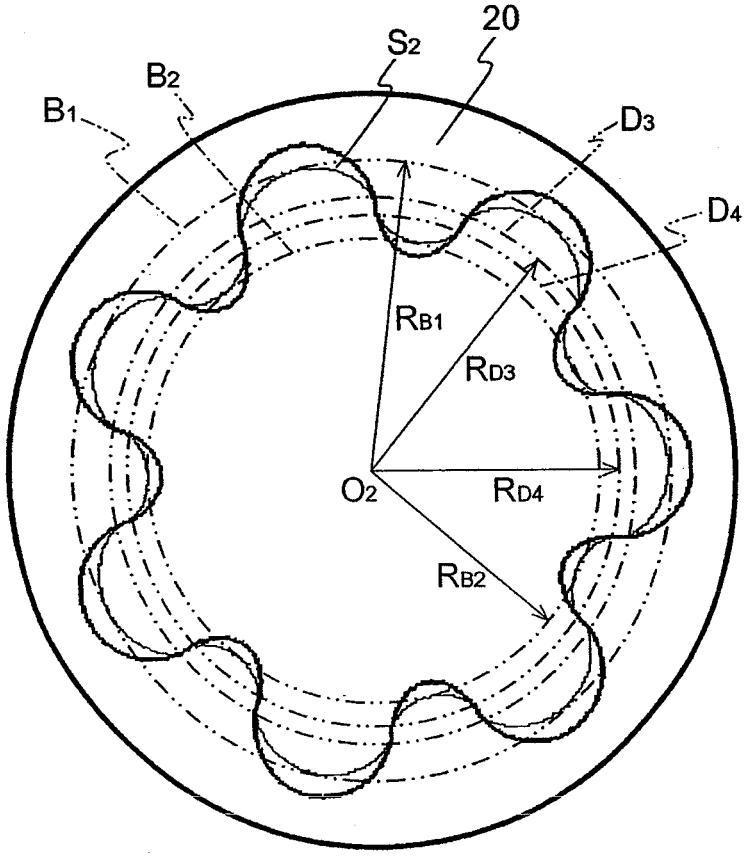
[FIG. 4] a plan view of an outer rotor relating to the first embodiment.
Figure 5:
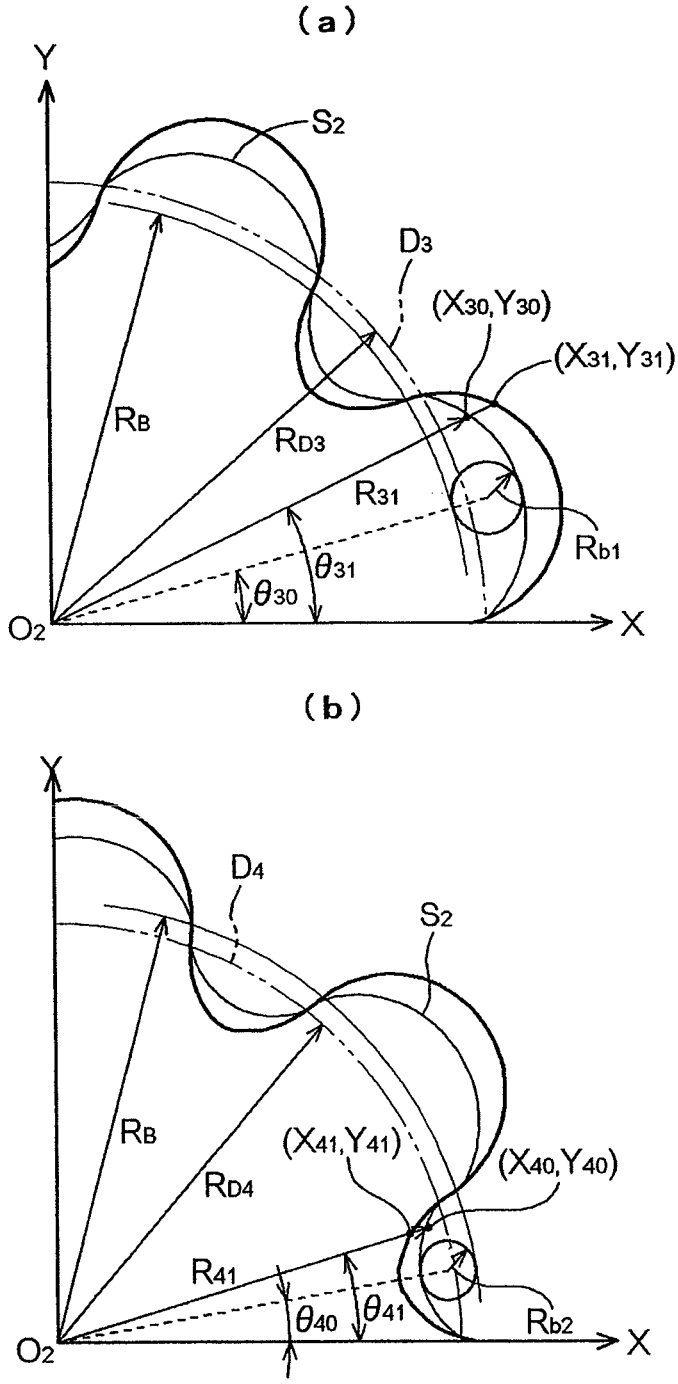
[FIG. 5] an explanatory view for forming an outer rotor relating to the first embodiment.
Figure 6:
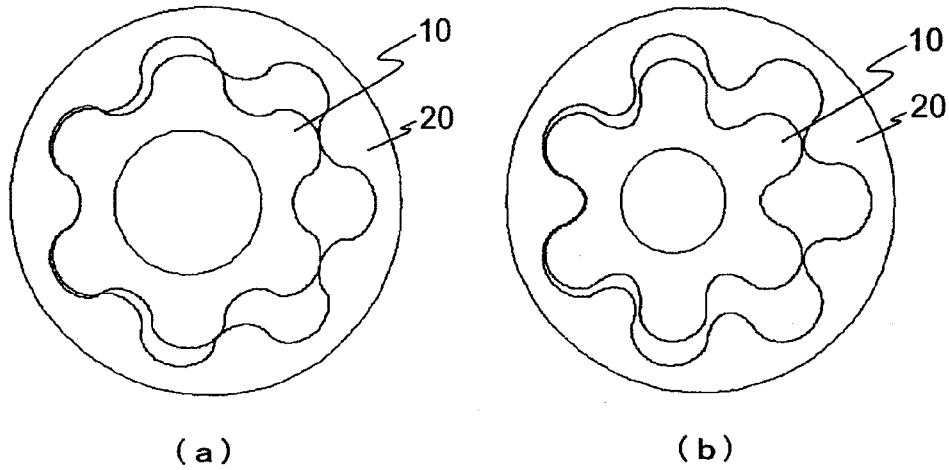
[FIG. 6] a plan view comparing the oil pump according to the present invention with a conventional oil pump.
Figure 7:
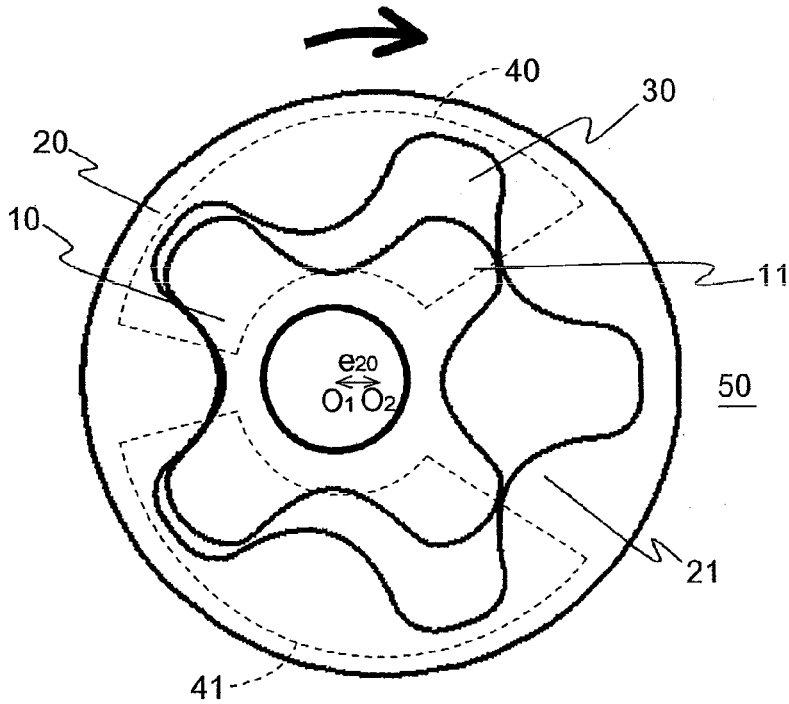
[FIG. 7] a plan view of an oil pump according to a second embodiment of the present invention.
Figure 8:
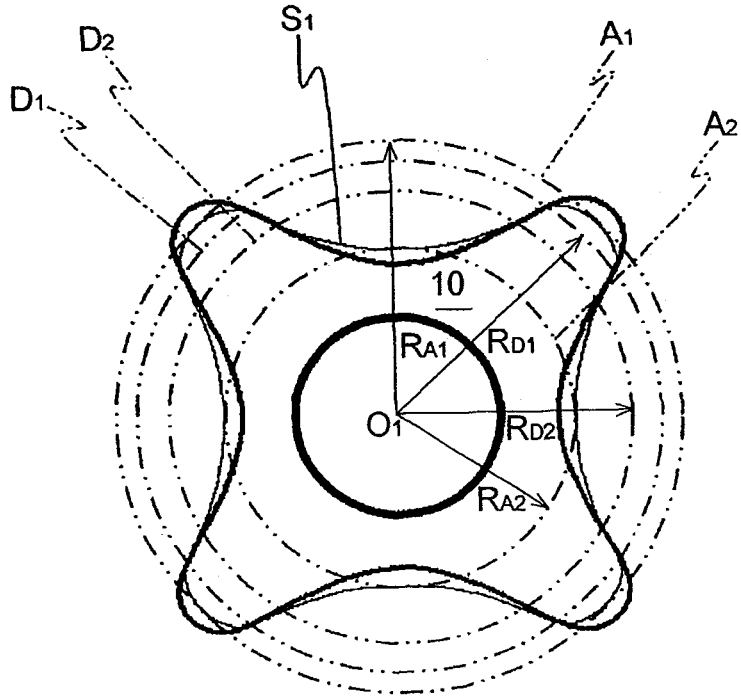
[FIG. 8] a plan view of an inner rotor relating to the second embodiment.
Figure 9:
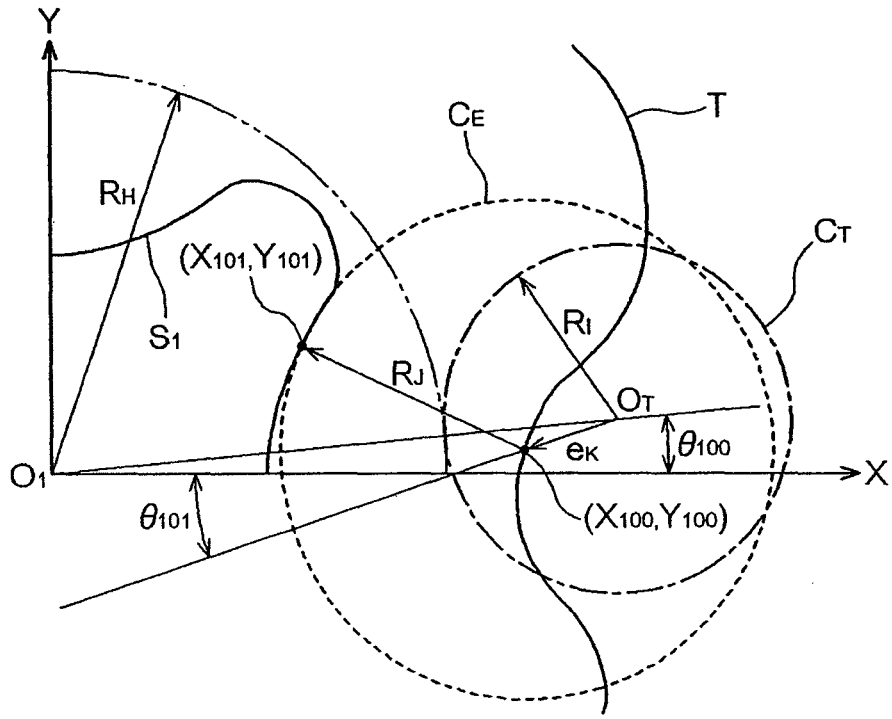
[FIG. 9] an explanatory view of forming the inner rotor relating to the second embodiment.
Figure 9:
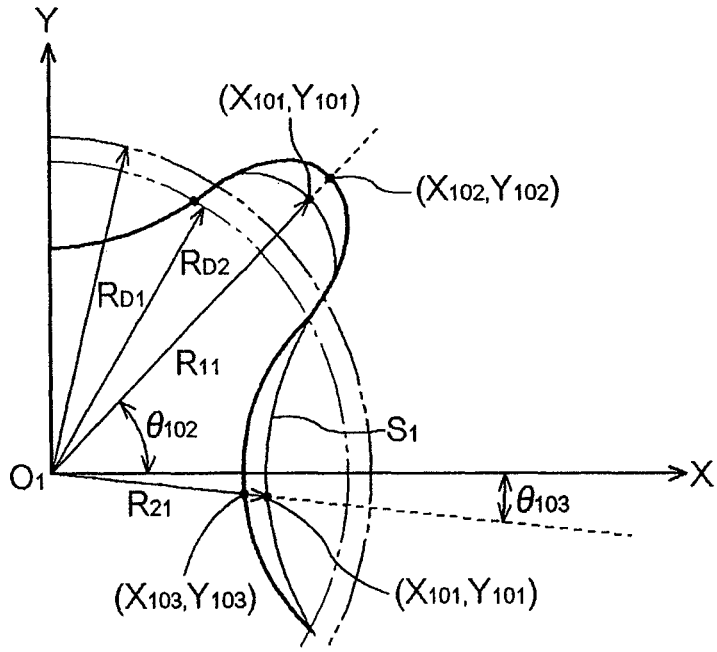
Figure 10:
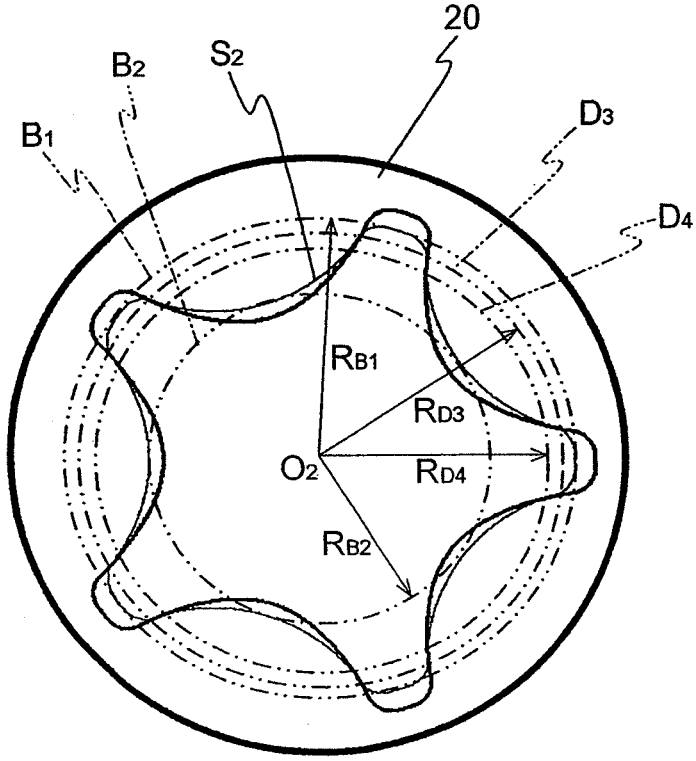
[FIG. 10] a plan view of an outer rotor relating to the second embodiment.
Figure 11:
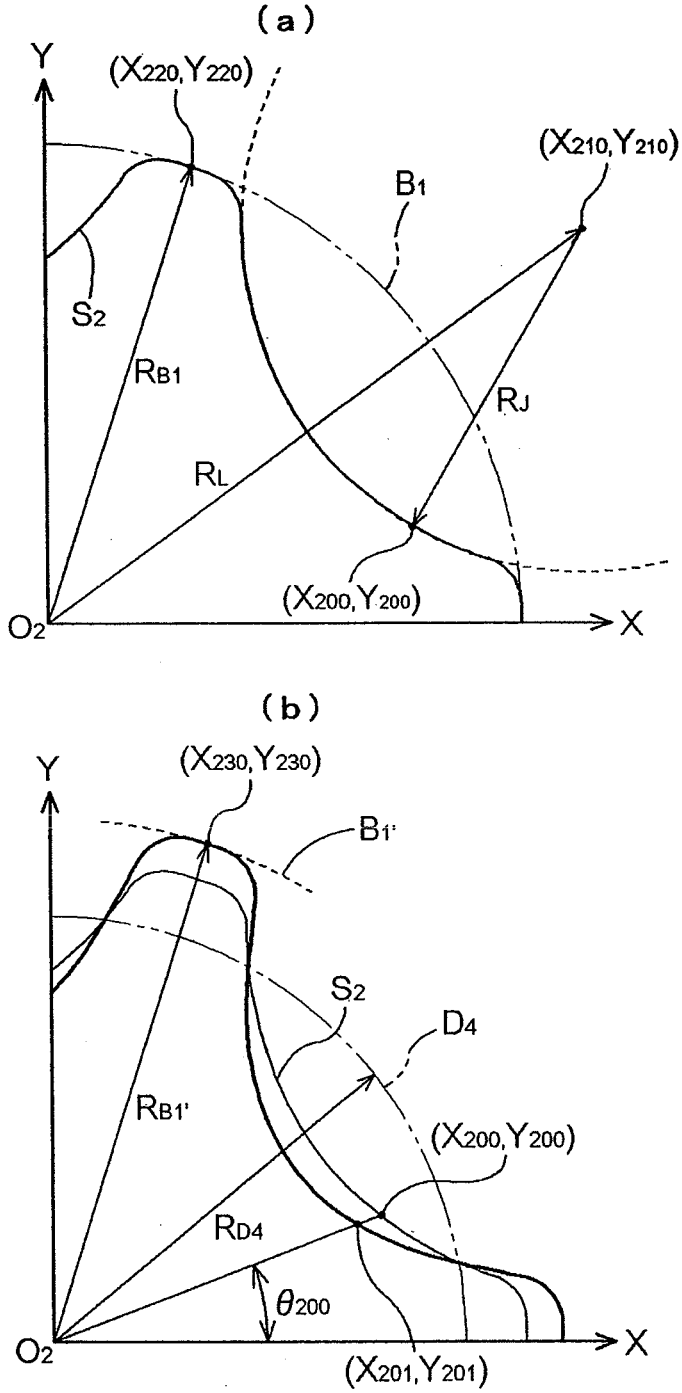
[FIG. 11] an explanatory view for forming the outer rotor relating to the second embodiment.
Figure 12:
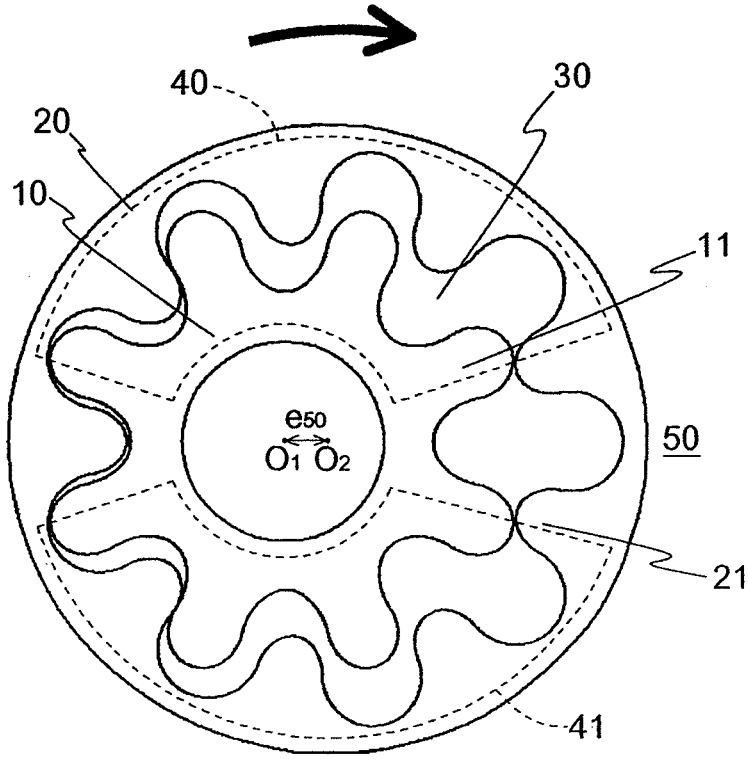
[FIG. 12] a plan view of an oil pump according to a third embodiment of the present invention.
Figure 13:
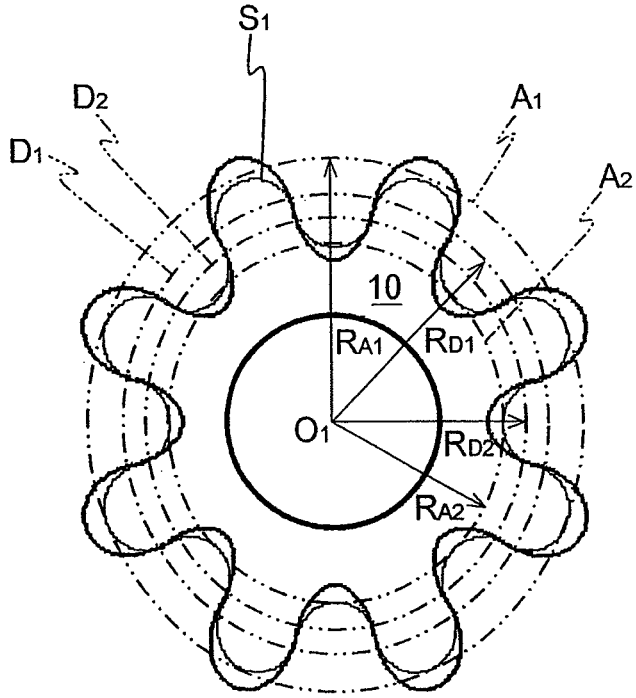
[FIG. 13] a plan view of an inner rotor relating to the third embodiment.
Figure 14:
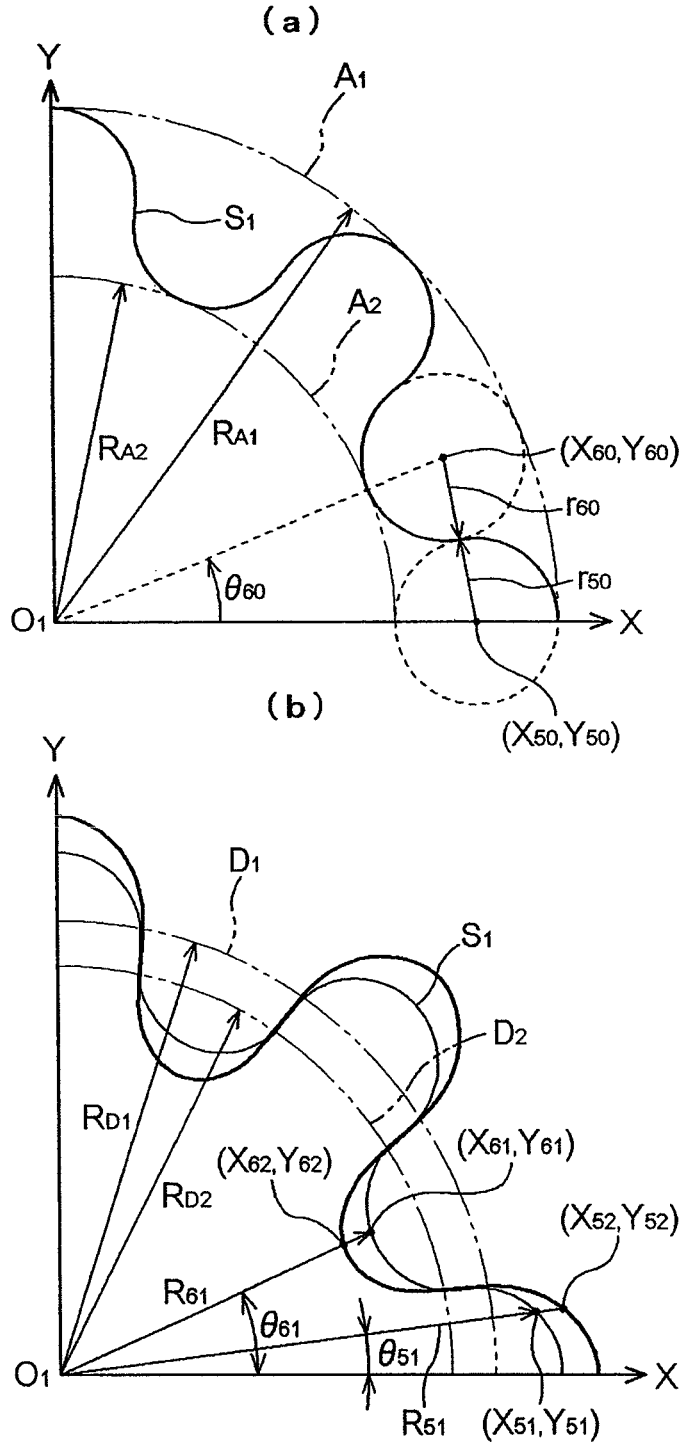
[FIG. 14] an explanatory view of forming the inner rotor relating to the third embodiment.
Figure 15:
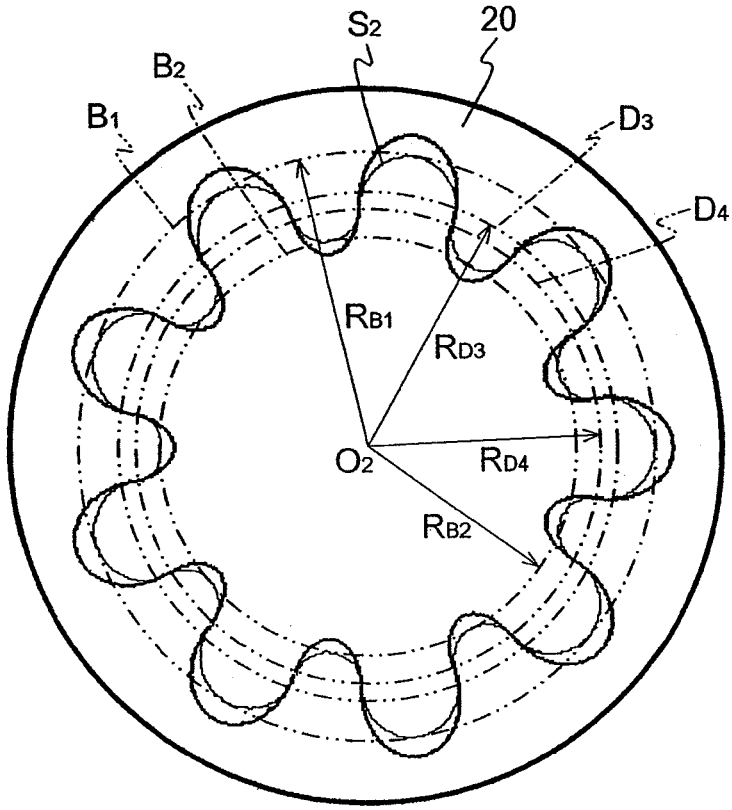
[FIG. 15] a plan view of an outer rotor relating to the third embodiment.
Figure 16:
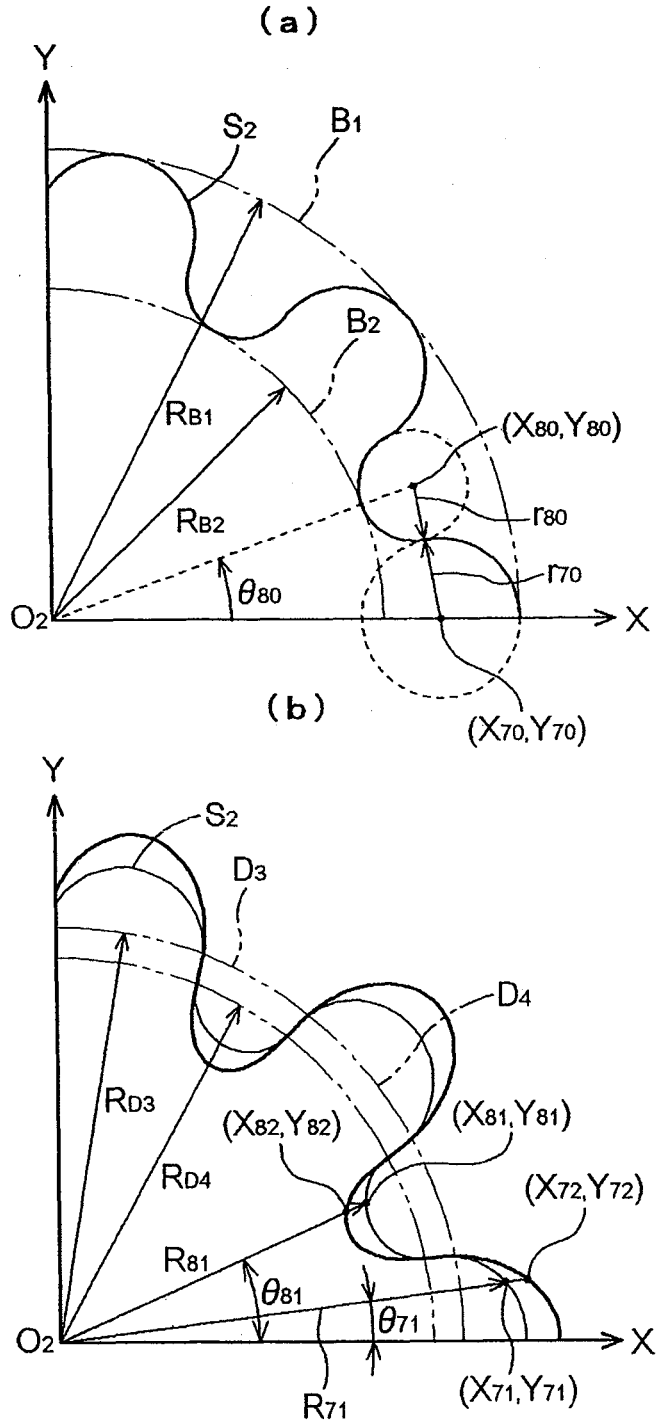
[FIG. 16] an explanatory view for forming the outer rotor relating to the third embodiment.
Figure 17:
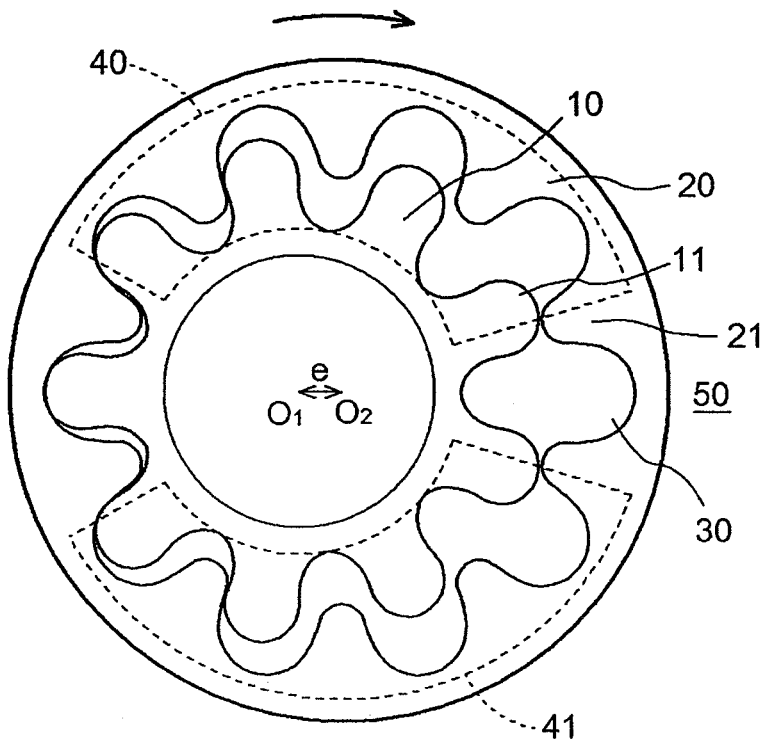
[FIG. 17] an explanatory view of an oil pump according to a fourth embodiment of the present invention.
Figure 18:
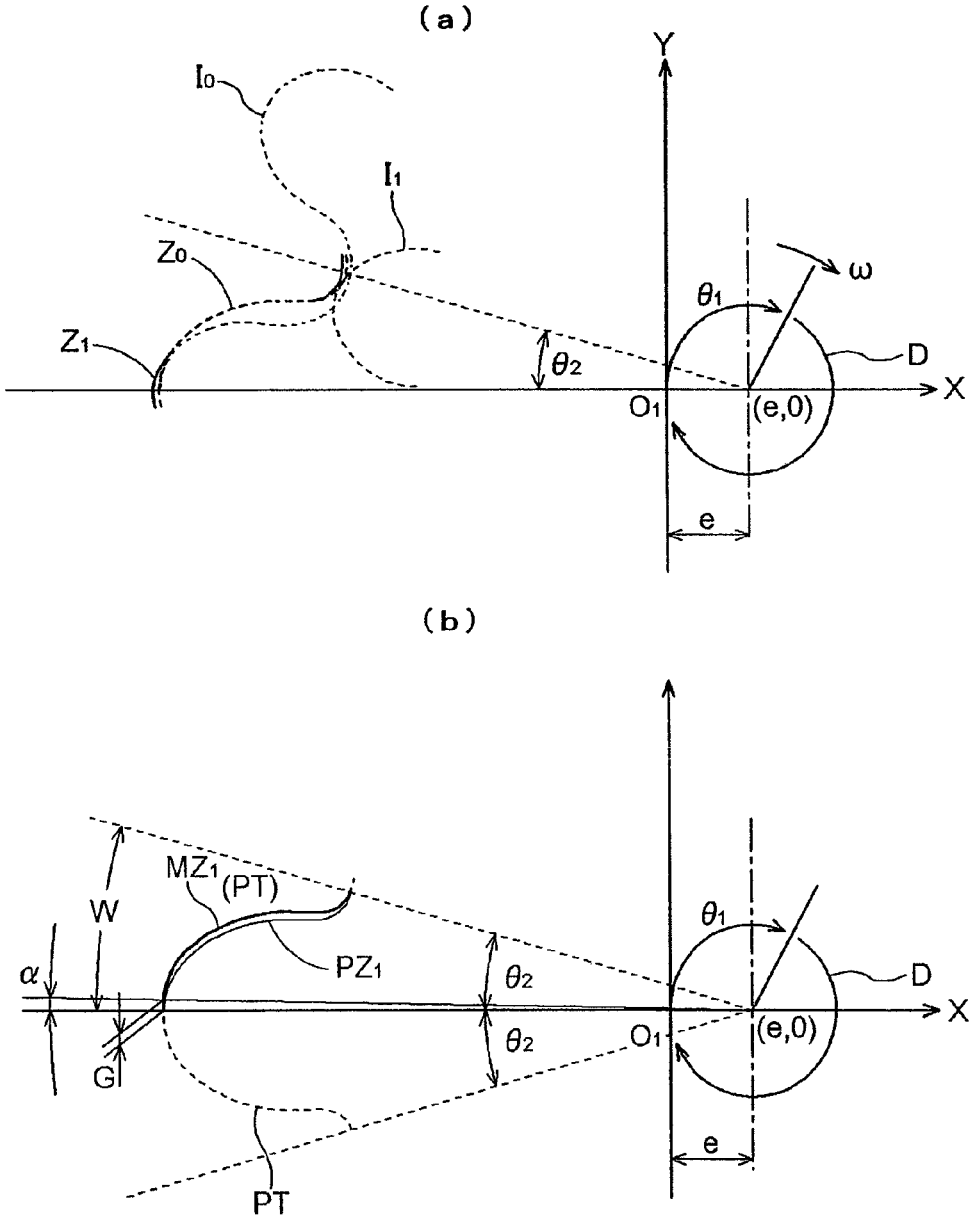
[FIG. 18] an explanatory view for forming the outer rotor relating to the fourth embodiment.
Figure 19:
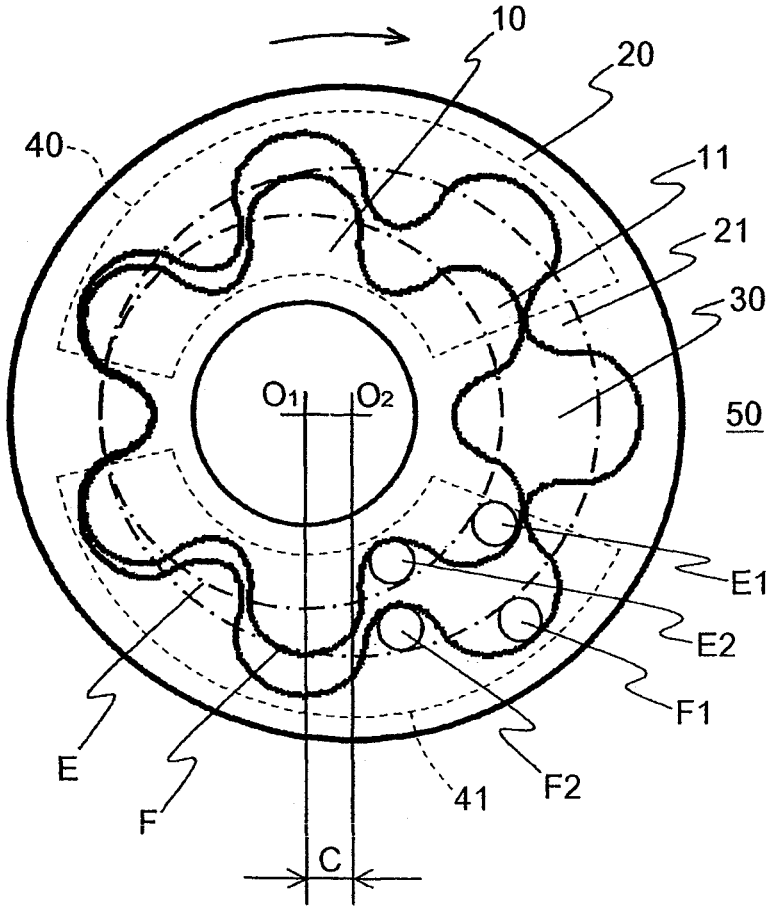
[FIG. 19] a plan view of an oil pump according to a fifth embodiment of the present invention.
Figure 20:
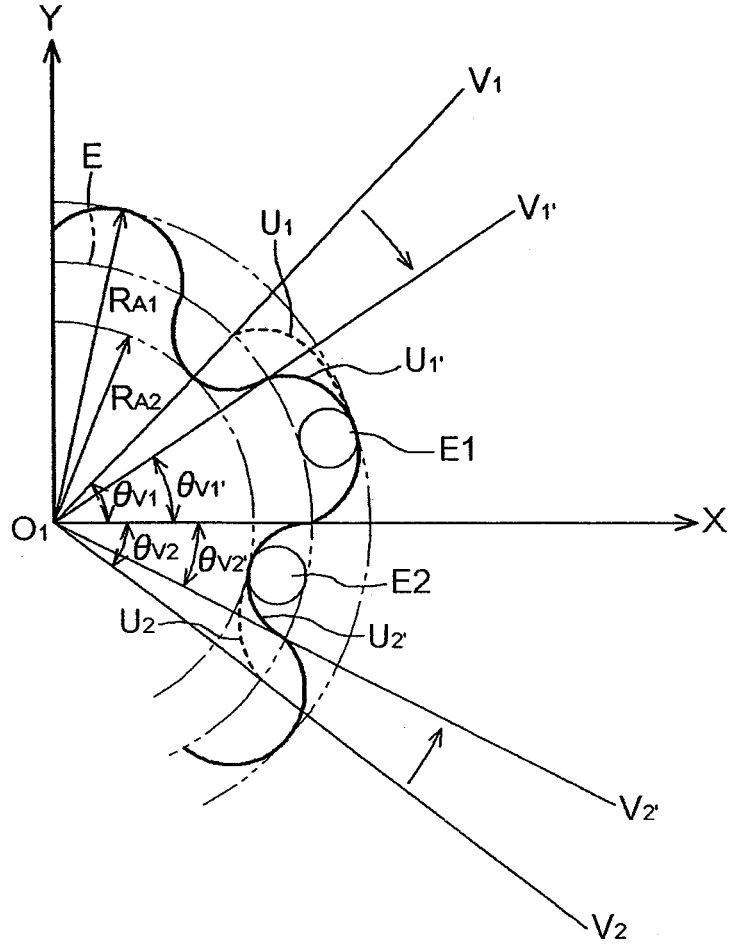
[FIG. 20] an explanatory view for forming the inner rotor relating to the fifth embodiment.

10 inner rotor
20 outer rotor
21 internal teeth
30 cells
40 suction port
41 discharge port
50 casing

The invention claimed is:

1. An oil pump rotor for use in an oil pump including an inner rotor having n external teeth, wherein n is a natural number, an outer rotor having n+1 internal teeth meshing with the external teeth, and a casing forming a suction port for drawing a fluid and a discharge port for discharging the fluid, such that in association with meshing and co-rotation of the inner and outer rotors, the fluid is drawn/discharged to be conveyed according to volume changes of cells formed between teeth faces of the two rotors;

wherein, for a tooth profile formed of a mathematical curve and having a tooth addendum circle A1 with a radius $R_{A1}$ and a tooth root curve $A_2$ with a radius $R_{A2}$, a circle $D_1$ has a radius $R_{D1}$ which satisfies at least Formula 1, $$R_{A1}>R_{D1}>R_{A2} \quad \text{Formula 1}$$

$$R_{A1}>R_{D2}>R_{A2} \quad \text{Formula 2}$$

$$R_{D1}\geq R_{D2} \quad \text{Formula 3}$$

a tooth profile of the external teeth of the inner rotor comprises at least either one of a modification, in a radially outer direction, of said tooth profile, on the outer side of said circle $D_1$ and a modification, in a radially inner direction, of said tooth profile, on the inner side of a circle $D_2$; and wherein said mathematical curve comprises an envelope of a family of arcs having centers on a trochoid curve defined by Formulas 21 through 26, and relative to said addendum circle $A_1$ and said root circle $A_2$, said external tooth profile of the inner rotor, in the case of the modification on the outer side of the circle $D_1$, has an addendum profile represented by coordinates obtained by Formulas 27 through 30, whereas said external tooth profile of the inner rotor, in the case of the modification on the inner side of the circle $D_2$, has a root profile represented bycoordinates obtained by Formulas 31 through 34, $$X_{100}=(R_H+R_I)\times\cos\theta_{100}-e_K\times\cos\theta_{101} \quad \text{Formula 21}$$

$$Y_{100}=(R_H+R_I)\times\sin\theta_{100}-e_K\times\sin\theta_{101} \quad \text{Formula 22}$$

$$\theta_{101}=(n+1)\times\theta_{100} \quad \text{Formula 23}$$

$$R_H=n\times R_I \quad \text{Formula 24}$$

$$X_{101}=X_{100}\pm R_J/\{1+(dX_{100}/dY_{100})^2\}^{1/2} \quad \text{Formula 25}$$

$$Y_{101}=Y_{100}\pm R_J/\{1+(dX_{100}/dY_{100})^2\}^{1/2} \quad \text{Formula 26}$$

where,

X axis: the straight line extending through the center of the inner rotor,

Y axis: the straight line perpendicular to the X axis and extending through the center of the inner rotor, $(X_{100}, Y_{100})$: coordinates on the trochoid curve, $R_H$: the radius of a basic circle of the trochoid curve, $R_I$: the radius of a trochoid curve generating circle, $e_K$: a distance between the center of the trochoid curve generating circle and a point generating the trochoid curve, $\theta_{100}$: an angle formed between the X axis and a straight line extending through the center of the trochoid curve generating circle and the inner rotor center, $\theta_{101}$: an angle formed between the X axis and a straight line extending through the center of the trochoid curve generating circle and the trochoid curve generating point, $(X_{101}, Y_{101})$: coordinates on the envelope, and $R_J$: the radius of the arcs E forming the envelope $$R_{11}=(X_{101}^2+Y_{101}^2)^{1/2} \quad \text{Formula 27}$$

$$\theta_{102}=\arccos(X_{101}/R_{11}) \quad \text{Formula 28}$$

$$X_{102}=\{(R_{11}-R_{D1})\times\beta_{100}+R_{D1}\}\times\cos\theta_{102} \quad \text{Formula 29}$$

$$Y_{102}=\{(R_{11}-R_{D1})\times\beta_{100}+R_{D1}\}\times\sin\theta_{102} \quad \text{Formula 30}$$

where, $R_{11}$: a distance from the inner rotor center to the coordinates $(X_{101}, Y_{101})$, $\theta_{102}$: an angle formed between the X axis and the straight line extending through the inner rotor center and the straight line extending through the coordinates $(X_{101}, Y_{101})$, $(X_{102}, Y_{102})$: coordinates of the addendum profile after modification, and $\beta_{100}$: a correction factor for modification $$R_{21}=(X_{101}^2+Y_{101}^2)^{1/2} \quad \text{Formula 31}$$

$$\theta_{103}=\arccos(X_{101}/R_{21}) \quad \text{Formula 32}$$

$$X_{103}=\{R_{D2}-(R_{D2}-R_{21})\times\beta_{101}\}\times\cos\theta_{103} \quad \text{Formula 33}$$

$$Y_{103}=\{R_{D2}-(R_{D2}-R_{21})\times\beta_{101}\}\times\sin\theta_{103} \quad \text{Formula 34}$$

where, $R_{21}$: a distance from the inner rotor center to the coordinates $(X_{101}, Y_{101})$, $\theta_{103}$: an angle formed between the X axis and the straight line extending through the inner rotor center and the straight line extending through the coordinates $(X_{101}, Y_{101})$, $(X_{103}, Y_{103})$: coordinates of the root profile after modification, and $\beta_{101}$: a correction factor for modification.

2. The oil pump rotor according to claim 1, wherein relative to a tooth profile formed by an arcuate curve represented by Formals 81 through 84 and having a root circle B1 with a radius $R_{B1}$ and an addendum circle B2 with a radius $R_{B2}$;

the internal tooth profile of the outer rotor meshing with the inner rotor has a root profile represented by Formula 85 in case said internal tooth profile is provided as a modification on the outer side of a circle $D_3$ having a radius $R_{D3}$ satisfying: $R_{B1}>R_{D3}>R_{B2}$;

the internal tooth profile of the outer rotor meshing with the inner rotor has an addendum profile represented by Formulas 86 and 87 in case said internal tooth profile is provided as a modification on the inner side of a circle $D_4$ having a radius $R_{D4}$ satisfying: $R_{B1}>R_{B4}>R_{B2}$ and $R_{D3}>R_{D4}$;

$$(X_{200}-X_{210})^2+(Y_{200}-Y_{210})^2=R_J^2 \quad \text{Formula 81}$$

$$X_{210}^2+Y_{210}^2=R_L^2 \quad \text{Formula 82}$$

$$X_{220}^2+Y_{220}^2=R_{B1}^2 \quad \text{Formula 83}$$

$$R_{B1}=(3\times R_{A1}-R_{A2})/2+g_{10} \quad \text{Formula 84}$$

where,

X axis: a straight line extending through the center of the outer rotor,

Y axis: a straight line perpendicular to the X axis and extending through the outer rotor center, $(X_{200}, Y_{200})$: coordinates of an arc forming the addendum portion, $(X_{210}, Y_{210})$: coordinates of the center of the circle whose arc forms the addendum portion, $(X_{220}, Y_{220})$: coordinates of an arc of the addendum circle B1 forming the addendum portion, $R_L$: a distance between the outer rotor center and the center of the circle forming whose arc folins the addendum portion, and $R_{B1}$: a radius of the root circle B1 forming the root portion $$X_{230}^2+Y_{230}^2=R_{B1}'^2 \quad \text{Formula 85}$$

where, $(X_{230}, Y_{230})$: coordinates of the root profile after the modification, and $RB_1'$: a radius of the arc forming the root portion after the modification.

$$X_{201}=(1-\beta_{200})\times R_{D4}\times\cos\theta_{200}+X_{200}\times\beta_{200}+g_{20} \quad \text{Formula 86}$$

$$Y_{201}=(1-\beta_{200})\times R_{D4}\times\sin\theta_{200}+Y_{200}\times\beta_{200}+g_{30} \quad \text{Formula 87}$$

where, $(X_{201}, Y_{201})$: coordinates of the addendum profile after the modification, $\theta_{200}$: an angle formed between the X axis and the straight line extending through the outer rotor center and the point $(X_{200}, Y_{200})$, $\beta_{200}$: a correction factor for modification, and $g_{10}$, $g_{20}$, $g_{30}$: correction amounts for allowing outer rotor rotation with clearance.

3. An oil pump rotor for use in an oil pump including an inner rotor having n external teeth, wherein n is a natural number, an outer rotor having n+1 internal teeth meshing with the external teeth, and a casing forming a suction port for drawing a fluid and a discharge port for discharging the fluid, such that in association with meshing and co-rotation of the inner and outer rotors, the fluid is drawn/discharged to be conveyed according to volume changes of cells formed between teeth faces of the two rotors;

wherein, for a tooth profile formed of a mathematical curve and having a tooth addendum circle A1 with a radius $R_{A1}$ and a tooth root curve $A_2$ with a radius $R_{A2}$, a circle $D_1$ has a radius $R_{D1}$ which satisfies at least Formula 1, $$R_{A1}>R_{D1}>R_{A2} \quad \text{Formula 1}$$

$$R_{A1}>R_{D2}>R_{A2} \quad \text{Formula 2}$$

$$R_{D1}\geq R_{D2} \quad \text{Formula 3}$$

a tooth profile of the external teeth of the inner rotor comprises at least either one of a modification, in a radially outer direction, of said tooth profile, on the outer side of said circle $D_1$ and a modification, in a radially inner direction, of said tooth profile, on the inner side of a circle $D_2$; and wherein said mathematical curve is formed by two arcs having an addendum portion and a root portion tangent to each other and is an arcuate curve represented by Formulas 41 through 46, and said external tooth profile of the inner rotor, in the case of the modification on the outer side of the circle $D_1$, has an addendum profile represented by coordinates obtained by Formulas 47 through 50, whereas said external tooth profile of the inner rotor, in the case of the modification on the inner side of the circle $D_2$, has a root profile represented by coordinates obtained by Formulas 51 through 54

$$(X_{50}-X_{60})^2+(Y_{50}-Y_{60})^2=(r_{50}+r_{60})^2 \quad \text{Formula 41}$$

$$X_{60}=(R_{A2}+r_{60})\cos\theta_{60} \quad \text{Formula 42}$$

$$Y_{60}=(R_{A2}+r_{60})\sin\theta_{60} \quad \text{Formula 43}$$

$$X_{50}=R_{A1}-r_{50} \quad \text{Formula 44}$$

$$Y_{50}=0 \quad \text{Formula 45}$$

$$\theta_{60}=\pi/n \quad \text{Formula 46}$$

where,

X axis: a straight line extending through the center of the inner rotor,

Y axis: a straight line perpendicular to the X axis and extending through the center of the inner rotor, $(X_{50}, Y_{50})$: coordinates of the center of the arc forming the tooth addendum portion, $(X_{60}, Y_{60})$: coordinates of the center of the arc forming the tooth root portion, $r_{50}$: the radius of the arc forming the tooth addendum portion, $r_{60}$: the radius of the arc forming the tooth root portion, $\theta_{60}$: an angle formed between the straight line extending through the center of the arc forming the tooth addendum portion and the center of the inner rotor and the straight line extending through the center of the arc forming the tooth root portion and the center of the inner rotor, $$R_{51}=(X_{51}^2+Y_{51}^2)^{1/2} \quad \text{Formula 47}$$

$$\theta_{51}=\arccos(X_{51}/R_{51}) \quad \text{Formula 48}$$

$$X_{52}=\{(R_{51}-R_{D1})\times\beta_{50}+R_{D1}\}\times\cos\theta_{51} \quad \text{Formula 49}$$

$$Y_{52}=\{(R_{51}-R_{D1})\times\beta_{50}+R_{D1}\}\times\sin\theta_{51} \quad \text{Formula 50}$$

where, $(X_{51}, Y_{51})$: coordinates of the points on the arc forming the tooth addendum portion, $R_{51}$: a distance from the center of the inner rotor to the coordinates $(X_{51}, Y_{51})$, $\theta_{51}$: an angle formed between the X axis and the straight line extending through the center of the inner rotor and the coordinates $(X_{51}, Y_{51})$, $(X_{52}, Y_{52})$: the coordinates of the addendum profile after the modification, $\beta_{50}$: a correction factor for modification $$R_{61}=(X_{61}^2+Y_{61}^2)^{1/2} \quad \text{Formula 51}$$

$$\theta_{61}=\arccos(X_{61}/R_{61}) \quad \text{Formula 52}$$

$$X_{62}=\{R_{D2}-(R_{D2}-R_{61})\times\beta_{60}\}\times\cos\theta_{61} \quad \text{Formula 53}$$

$$Y_{62}=\{R_{D2}-(R_{D2}-R_{61})\times\beta_{60}\}\times\sin\theta_{61} \quad \text{Formula 54}$$

where, $(X_{61}, Y_{61})$: coordinates of the points on the arc forming the tooth root portion, $R_{61}$: a distance from the center of the inner rotor to the coordinates $(X_{61}, Y_{61})$, $\theta_{61}$: an angle formed between the X axis and the straight line extending through the center of the inner rotor and the coordinates $(X_{61}, Y_{61})$, $(X_{62}, Y_{62})$: the coordinates of the root profile after the modification, $\beta_{60}$: a correction factor for modification.

4. The oil pump rotor according to claim 2, wherein relative to a tooth profile formed by an arcuate curve represented by Formals 101 through 106 and having a root circle $B_1$ with a radius $R_{B1}$ and an addendum circle $B_2$ with a radius $R_{B2}$;

the internal tooth profile of the outer rotor meshing with the inner rotor has a root profile represented by Formulas 107 through 110 in case said internal tooth profile is provided as a modification on the outer side of a circle $D_3$ having a radius $R_{D3}$ satisfying: $R_{B1}>R_{D3}>R_{B2}$;

the internal tooth profile of the outer rotor meshing with the inner rotor has an addendum profile represented by Formulas 111 through 114 in case said internal tooth profile is provided as a modification on the inner side of a circle $D_4$ having a radius $R_{D4}$ satisfying: $R_{B1}>R_{D4}>R_{B2}$ and $R_{D3}=R_{D4}$; and the internal tooth profile of the outer rotor satisfies the following relationships of Formulas 115 through 117 relative to the inner rotor;

$$(X_{70}-Y_{80})^2+(Y_{70}-Y_{80})^2=(r_{70}+r_{80})^2 \quad \text{Formula 101}$$

$$X_{80}=(R_{B2}+r_{80})\cos\theta_{80} \quad \text{Formula 102}$$

$$Y_{80}=(R_{B2}+r_{80})\sin\theta_{80} \quad \text{Formula 103}$$

$$X_{70}=R_{B1}-r_{70} \quad \text{Formula 104}$$

$$Y_{70}=0 \quad \text{Formula 105}$$

$$\theta_{80}=\pi/(n+1) \quad \text{Formula 106}$$

where,

X axis: a straight line extending through the center of the outer rotor,

Y axis: a straight line perpendicular to the X axis and extending through the center of the outer rotor, $(X_{70}, Y_{70})$: coordinates of the center of the arc forming the root portion, $(X_{80}, Y_{80})$: coordinates of the center of the arc forming the addendum portion, $r_{70}$: the radius of the arc forming the root portion, $r_{80}$: the radius of the arc forming the addendum portion, $\theta_{80}$: an angle formed between the straight line extending through the center of the arc forming the addendum portion and the center of the outer rotor and the straight line extending through the center of the arc forming the root portion and the center of the outer rotor, $$R_{71}=(X_{71}^2+Y_{71}^2)^{1/2} \quad \text{Formula 107}$$

$$\theta_{71}=\arccos(X_{71}/R_{71}) \quad \text{Formula 108}$$

$$X_{72}=\{(R_{71}-R_{D3})\times\beta_{70}+R_{D3}\}\times\cos\theta_{71} \quad \text{Formula 109}$$

$$Y_{72}=\{(R_{71}-R_{D3})\times\beta_{70}+R_{D3}\}\times\sin\theta_{71} \quad \text{Formula 110}$$

where, $(X_{71}, Y_{71})$: coordinates of the point on the arc forming the addendum portion, $R_{71}$: a distance from the center of the outer rotor to the coordinates $(X_{71}, Y_{71})$, $\theta_{71}$: an angle formed between the X axis and the straight line extending through the center of the outer rotor and the coordinates $(X_{71}, Y_{71})$, $(X_{72}, Y_{72})$: the coordinates of the addendum profile after the modification, $\beta_{70}$: a correction factor for modification $$R_{81}=(X_{81}^2+Y_{81}^2)^{1/2} \quad \text{Formula 111}$$

$$\theta_{81}=\arccos(X_{81}/R_{81}) \quad \text{Formula 112}$$

$$X_{81}=\{R_{D4}-(R_{D4}-R_{81})\times\beta_{80}\}\times\cos\theta_{81} \quad \text{Formula 113}$$

$$Y_{81}=\{R_{D4}-(R_{D4}-R_{81})\times\beta_{80}\}\times\sin\theta_{81} \quad \text{Formula 114}$$

where, $(X_{81}, Y_{81})$. coordinates of the point on the arc forming the addendum portion, $R_{81}$: a distance from the center of the outer rotor to the coordinates $(X_{81}, Y_{81})$, $\theta_{81}$: an angle formed between the X axis and the straight line extending through the center of the outer rotor and the coordinates $(X_{81}, Y_{81})$, $(X_{82}, Y_{82})$: the coordinates of the addendum profile after the modification, $\beta_{80}$: a correction factor for modification $$e_{50}=[\{(R_{A1}-R_{D1})\times\beta_{50}+R_{D1}\}-\{R_{D2}-(R_{D2}-R_{A2})\times\beta_{60}\}]/2+d_{50} \quad \text{Formula 115}$$

$$R_{B1}'=3/2[\{R_{A1}-R_{D1}\}\times\beta_{50}+R_{D1}]-1/2\times\{R_{D2}-(R_{D2}-R_{A2})\times\beta_{60}\}+d_{60} \quad \text{Formula 116}$$

$$R_{B2}'=[\{(R_{A1}-R_{D1})\times\beta_{50}+R_{D1}\}+\{R_{D2}-(R_{D2}-R_{A2})\times\beta_{60}\}]/2+d7_0 \quad \text{Formula 117}$$

where, $e_{50}$: a distance between the center of the inner rotor and the center of the outer rotor (eccentricity amount), $R_{B1}'$: the radius of the root circle of the outer rotor after the modification, $R_{B2}'$: the radius of the addendum circle of the outer rotor after the modification, and $d_{50}$, $d_{60}$, $d_{70}$: correction amounts for allowing outer rotor rotation with clearance.

5. An oil pump rotor for use in an oil pump including an inner rotor having n external teeth, wherein n is a natural number, an outer rotor having n+1 internal teeth meshing with the external teeth, and a casing forming a suction port for drawing a fluid and a discharge port for discharging the fluid, such that in association with meshing and co-rotation of the inner and outer rotors, the fluid is drawn/discharged to be conveyed according to volume changes of cells formed between teeth faces of the two rotors;

wherein the outer rotor meshing with the inner rotor has a tooth profile formed by a method comprising the steps of:

revolving the inner rotor in a direction on a perimeter of a circle D at an angular velocity ω, said circle D having a center offset from the center of the inner rotor by a predetermined distance e and having a radius e equal to said predetermined distance;

rotating, at the same time, the inner rotor on its own axis in the direction opposite to said direction of revolution at an angular velocity (ω/n) which is 1/n times said angular velocity (ω) of the revolution, thereby forming an envelope;

providing, as a 0-revolution angle direction, an angle as seen at the time of the start of the revolution from the center of said circle D toward the center of the inner rotor;

modifying vicinity of an intersection between said envelope and an axis along said 0-revolution angle direction toward a radially outer side, modifying vicinity of an intersection between said envelope and an axis along a π/(n+1) revolution angle direction of the inner rotor toward a radially outer side by an amount smaller than or equal to the amount of said radially outer modification of the vicinity of the intersection with the 0-revolution angle axis;

extracting a portion of said envelope contained in an angular area greater than 0-revolution angle and less than π/(n+1) revolution angle, as a partial envelope;

rotating said partial envelope by a small angle α along the revolution direction about the center of said circle D, removing a further portion of said envelope extending out of said angular area and connecting, to said removed portion, a gap formed between said partial envelope and said 0-revolution angle axis, thereby forming a corrected partial envelope;

copying said corrected partial envelope in line symmetry relative to said 0-revolution angle axis, thereby forming a partial tooth profile; and copying said partial tooth profile by rotating it about the center of said circle D for a plurality of times for an angle: 2π/(n+1) for each time, thereby forming the tooth profile of the outer rotor.

6. An oil pump rotor for use in an oil pump including an inner rotor having n external teeth, wherein n is a natural number, an outer rotor having n+1 internal teeth meshing with the external teeth, and a casing forming a suction port for drawing a fluid and a discharge port for discharging the fluid, such that in association with rotation of the inner rotor, the external teeth thereof mesh with the internal teeth of the outer rotor, thus rotating this outer rotor and the fluid is drawn/discharged to be conveyed according to volume changes of cells formed between teeth faces of the two rotors;

wherein a tooth addendum profile of the inner rotor comprises a modification, based on Formulas 201 and 203, of a first epicycloid curve generated by a first epicycloid E1 rolling, without slipping, around outside a basic circle E thereof, a tooth root profile of the inner rotor comprises a modification, based on Formulas (201), and (203), of a first hypocycloid curve generated by a first hypocycloid E2 rolling without slipping, around inside said basic circle E thereof, a tooth root profile of the outer rotor comprises a modification, based on Formulas 201 and 203, of a second epicycloid curve generated by a second epicycloid F1 rolling, without slipping, around outside a basic circle F thereof, and a tooth addendum profile of the outer rotor comprises a modification, based on Formulas 201 and 203, of a second hypocycloid curve generated by a second hypocycloid F2 rolling, without slipping, around inside said basic circle F thereof $$\phi E = n \times (\phi E1 \times \alpha 1 + \phi E2 \times \alpha 2) \quad \text{Formula 201}$$

$$\phi F = (n+1) \times (\phi F1 \times \beta 1 + \phi F2 \times \beta 2) \quad \text{Formula 202}$$

$$\phi E1 + \phi E2 + H1 = \phi F1 + \phi F2 + H2 = 2C \quad \text{Formula 203}$$

In the above Formulas 201, 202, and 203;

ϕE: the diameter of the basic circle E of the inner rotor,

ϕE1 : the diameter of the first epicycloid E1,

ϕE2: the diameter of the first hypocycloid E1,

ϕF: the diameter of the basic circle of the outer rotor,

ϕF1: the diameter of the second epicycloid F1,

ϕF2: the diameter of the second hypocycloid F2,

C: an eccentricity amount between the inner rotor and the outer rotor,

α1: a correction factor for the epicycloid ϕF1,

α2: a correction factor for the hypocycloid ϕE2,

β1: a correction factor for the epicycloid ϕF1,

β2: a correction factor for the hypocycloid ϕF2, and

H1, H2: correction factors for the eccentricity amount C, where $0<\alpha 1<1$;

$0<\alpha 2<1$;

$0<\beta 1<1$;

$0<\beta 2<1$;

$-1<H1<1$;

$-1<H2<1$.

7. An oil pump rotor for use in an oil pump including an inner rotor having n external teeth, wherein n is a natural number, an outer rotor having n+1 internal teeth meshing with the external teeth, and a casing forming a suction port for drawing a fluid and a discharge port for discharging the fluid, such that in association with meshing and co-rotation of the inner and outer rotors, the fluid is drawn/discharged to be conveyed according to volume changes of cells formed between teeth faces of the two rotors;

wherein, for a tooth profile formed of a mathematical curve and having a tooth addendum circle $A_1$ with a radius $R_{A1}$ and a tooth root curve $A_2$ with a radius $R_{A2}$, a circle $D_1$ has a radius $R_{D1}$ which satisfies Formula 1 and a circle $D_2$ has a radius $R_{D2}$ which satisfies both Formula 2 and Formula 3, $$R_{A1} > R_{D1} > R_{A2} \quad \text{Formula 1}$$

$$R_{A1} > R_{D2} > R_{A2} \quad \text{Formula 2}$$

$$R_{D1} \geq R_{D2} \quad \text{Formula 3}$$

a tooth profile of the external teeth of the inner rotor comprises at least either one of a modification, in a radially outer direction, of said tooth profile, on the outer side of said circle D1 and a modification, in a radially inner direction, of said tooth profile, on the inner side of a circle $D_2$;

wherein said mathematical curve comprises an envelope of a family of arcs having centers on a trochoid curve defined by Formals 21 through 26, and relative to said addendum circle Al and said root circle A2, said external tooth profile of the inner rotor, in the case of the modification on the outer side of the circle $D_1$, has an addendum profile represented by coordinates obtained by Formulas 27 through 30, whereas said external tooth profile of the inner rotor, in the case of the modification on the inner side of the circle $D_2$, has a root profile represented by coordinates obtained by Formulas 31 through 34, $$X_{100}=(R_H+R_I)\times\cos\theta_{100}-e_K\times\cos\theta_{101} \quad \text{Formula 21}$$

$$Y_{100}=(R_H+R_I)\times\sin\theta_{100}-e_K\times\sin\theta_{101} \quad \text{Formula 22}$$

$$\theta_{101}=(n+1)\times\theta_{100} \quad \text{Formula 23}$$

$$R_H=n\times R_I \quad \text{Formula 24}$$

$$X_{101}=X_{100}\pm R_J/\{1+(dX_{100}/dY_{100})^2\}^{1/2} \quad \text{Formula 25}$$

$$Y_{101}=Y_{100}\pm R_J/\{1+(dX_{100}/dY_{100})^2\}^{1/2} \quad \text{Formula 26}$$

where

X axis: the straight line extending through the center of the inner rotor,

Y axis: the straight line perpendicular to the X axis and extending through the center of the inner rotor, $(X_{100}, Y_{l00})$: coordinates on the trochoid curve, $R_H$: the radius of a basic circle of the trochoid curve, $R_I$: the radius of a trochoid curve generating circle, $e_K$: a distance between the center of the trochoid curve generating circle and a point generating the trochoid curve, $\theta_{100}$ an angle formed between the X axis and a straight line extending through the center of the trochoid curve generating circle and the inner rotor center, $\theta_{101}$ an angle formed between the X axis and a straight line extending through the center of the trochoid curve generating circle and the trochoid curve generating point, $(X_{101}, Y_{101})$: coordinates on the envelope, and $R_J$: the radius of the arcs E forming the envelope $$R_{11}=(X_{101}^2+Y_{101}^2)^{1/2} \quad \text{Formula 27}$$

$$\theta_{102}=\arccos(X_{101}/R_{11}) \quad \text{Formula 28}$$

$$X_{102}=\{(R_{11}-R_{D1})\times\beta_{100}+R_{D1}\}\times\cos\theta_{102} \quad \text{Formula 29}$$

$$Y_{102}=\{(R_{11}-R_{D1})\times\beta_{100}+R_{D1}\}\times\sin\theta_{102} \quad \text{Formula 30}$$

where, $R_{11}$: a distance from the inner rotor center to the coordinates $(X_{101}, Y_{101})$ $\theta_{102}$: an angle formed between the X axis and the straight line extending through the inner rotor center and the straight line extending through the coordinates $(X_{101}, Y_{101})$, $(X_{102}, Y_{102})$: coordinates of the addendum profile after modification, and a $\beta_{100}$: a correction factor for modification $$R_{21}=(X_{101}^2+Y_{101}^2)^{1/2} \quad \text{Formula 31}$$

$$\theta_{103}=\arccos(X_{101}/R_{21}) \quad \text{Formula 32}$$

$$X_{103}=\{R_{D2}-(R_{D2}-R_{21})\times\beta_{101}\}\times\cos\theta_{103} \quad \text{Formula 33}$$

$$Y_{103}=\{R_{D2}-(R_{D2}-R_{21})\times\beta_{101}\}\times\sin\theta_{103} \quad \text{Formula 34}$$

where $R_{21}$: a distance from the inner rotor center to the coordinates $(X_{101}, Y_{101})$, $\theta_{103}$: an angle foamed between the X axis and the straight line extending through the inner rotor center and the straight line extending through the coordinates $(X_{101}, Y_{101})$.

$(X_{103}, Y_{103})$: coordinates of the root profile after modification, and $\beta_{101}$: a correction factor for modification.

8. An oil pump rotor for use in an oil pump including an inner rotor having n external teeth, wherein n is a natural number, an outer rotor having n+1 internal teeth meshing with the external teeth, and a casing forming a suction port for drawing a fluid and a discharge port for discharging the fluid, such that in association with meshing and co-rotation of the inner and outer rotors, the fluid is drawn/discharged to be conveyed according to volume changes of cells formed between teeth faces of the two rotors;

wherein, for a tooth profile formed of a mathematical curve and having a tooth addendum circle $A_1$ with a radius $R_{A1}$, and a tooth root curve $A_2$ with a radius $R_{A2}$, a circle $D_1$ has a radius $R_{D1}$ which satisfies Formula 1 and a circle $D_2$ has a radius $R_{D2}$ which satisfies both Formula 2 and Formula 3, $$R_{A1}>R_{D1}>R_{A2} \quad \text{Formula 1}$$

$$R_{A1}>R_{D2}>R_{A2} \quad \text{Formula 2}$$

$$R_{D1}\geq R_{D2} \quad \text{Formula 3}$$

a tooth profile of the external teeth of the inner rotor comprises at least either one of a modification, in a radially outer direction, of said tooth profile, on the outer side of said circle $D_1$ and a modification, in a radially inner direction, of said tooth profile, on the inner side of a circle D, wherein said mathematical curve is formed by two arcs having an addendum portion and a root portion tangent to each other and is an arcuate curve represented by Formulas 41 through 46, and said external tooth profile of the inner rotor, in the case of the modification on the outer side of the circle D, has an addendum profile represented by coordinates obtained by Formulas 47 through 50, whereas said external tooth profile of the inner rotor, in the case of the modification on the inner side of the circle $D_2$ has a root a profile represented by coordinates obtained by Formulas 51 through 54

$$(X_{50}-X_{60})^2+(Y_{50}-Y_{60})^2=(r_{50}+r_{60})^2 \quad \text{Formula 41}$$

$$X_{60}=(R_{A2}+r_{60})\cos\theta_{60} \quad \text{Formula 42}$$

$$Y_{60}=(R_{A2}+r_{80})\sin\theta_{60} \quad \text{Formula 43}$$

$$X_{50}=R_{A1}-r_{50} \quad \text{Formula 44}$$

$$Y_{50}=0 \quad \text{Formula 45}$$

$$\theta_{60}=\pi/n \quad \text{Formula 46}$$

where,

X axis: a straight line extending through the center of the inner rotor,

Y axis: a straight line perpendicular to the X axis and extending through the center of the inner rotor, $(X_{50}, Y_{50})$: coordinates of the center of the arc forming the tooth addendum portion, $(X_{60}, Y_{60})$: coordinates of the center of the arc forming the tooth root portion, $r_{50}$: the radius of the arc forming the tooth addendum portion, $r_{60}$: the radius of the arc forming the tooth root portion.

$\theta_{60}$: an angle formed between the straight line extending through the center of the arc forming the tooth addendum portion and the center of the inner rotor and the straight line extending through the center of the arc forming the tooth root portion and the center of the inner rotor, $$R_{51}=(X_{51}^2+Y_{51}^2)^{1/2} \quad \text{Formula 47}$$

$$\theta_{51}=\arccos(X_{51}/R_{51}) \quad \text{Formula 48}$$

$$X_{52}=\{(R_{51}-R_{D1})\times\beta_{50}+R_{D1}\}\times\cos\theta_{51} \quad \text{Formula 49}$$

$$Y_{52}=\{(R_{51}-R_{D1})\times\beta_{50}+R_{D1}\}\times\sin\theta_{51} \quad \text{Formula 50}$$

where, $(X_{51}, Y_{51})$: coordinates of the points on the arc forming the tooth addendum portion, $R_{51}$: a distance from the center of the inner rotor to the coordinates ~

$\theta_{51}$: an angle formed between the X axis and the straight line extending through the center of the inner rotor and the coordinates $(X_{51}, Y_{51})$, $(X_{52}, Y_{52})$: the coordinates of the addendum profile after the modification, $\beta_{50}$: a correction factor for modification $$R_{61}=(X_{61}^2+Y_{61}^2)^{1/2} \quad \text{Formula 51}$$

$$\theta_{61}=\arccos(X_{61}/R_{61}) \quad \text{Formula 52}$$

$$X_{62}=\{R_{D2}-(R_{D2}-R_{61})\times\beta_{60}\}\times\cos\theta_{61} \quad \text{Formula 53}$$

$$Y_{62}=\{R_{D2}-(R_{D2}-R_{61})\times\beta_{60}\}\times\sin\theta_{61} \quad \text{Formula 54}$$

where, $(X_{61}, Y_{61})$: coordinates of the points on the arc forming the tooth addendum portion, $R_{61}$: a distance from the center of the inner rotor to the coordinates $(X_{61}, Y_{61})$, $\theta_{60}$:an angle formed between the X axis and the straight line extending through the center of the inner rotor and the coordinates $(X_{61}, Y_{61})$, $(X_{62}, Y_{62})$: the coordinates of the root profile after the modification, $\beta_{60}$: a correction factor for modification.

9. An oil pump rotor for use in an oil pump including an inner rotor having n external teeth, wherein n is a natural number, an outer rotor having n+1 internal teeth meshing with the external teeth, and a casing forming a suction port for drawing a fluid and a discharge port for discharging the fluid, such that in association with meshing and co-rotation of the inner and outer rotors, the fluid is drawn/discharged to be conveyed according to volume changes of cells formed between teeth faces of the two rotors;

wherein, for a tooth profile fanned of a mathematical curve and having a tooth addendum circle A1 with a radius $R_{A1}$ and a tooth root curve $A_2$ with a radius $R_{A2}$, a circle $D_1$ has a radius $R_{D1}$ which satisfies at least Formula 1, $$R_{A1}>R_{D1}>R_{A2} \quad \text{Formula 1}$$

$$R_{A1}>R_{D2}>R_{A2} \quad \text{Formula 2}$$

$$R_{D1}\geq R_{D2} \quad \text{Formula 3}$$

a tooth profile of the external teeth of the inner rotor comprises at least either one of a modification, in a radially outer direction, of said tooth profile, on the outer side of said circle $D_1$ and a modification, in a radially inner direction, of said tooth profile, on the inner side of a circle $D_2$;

wherein said tooth profile of the external teeth of the inner rotor is formed of both the radially outer modification of the tooth profile, on the outer side of the circle $D_1$ having the radius $R_{D1}$ satisfying said Formula 1 and the radially inner modification of said tooth profile, on the inner side of the circle $D_2$ having the radius $R_{D2}$ satisfying both Formula 2 and Formula 3; and wherein said mathematical curve comprises an envelope of a family of arcs having centers on a trochoid curve defined by Formals 21 through 26, and relative to said addendum circle $A_1$ and said root circle $A_2$, said external tooth profile of the inner rotor, in the case of the modification on the outer side of the circle $D_1$, has an addendum profile represented by coordinates obtained by Formulas 27 through 30, whereas said external tooth profile of the inner rotor, in the case of the modification on the inner side of the circle $D_2$, has a root profile represented by coordinates obtained by Formulas 31 through 34, $$X_{100}=(R_H+R_I)\times\cos\theta_{100}-e_K\times\cos\theta_{101} \quad \text{Formula 21}$$

$$Y_{100}=(R_H+R_I)\times\sin\theta_{100}-e_K\times\sin\theta_{101} \quad \text{Formula 22}$$

$$\theta_{101}=(n+1)\times\theta_{100} \quad \text{Formula 23}$$

$$R_H=n\times R_I \quad \text{Formula 24}$$

$$X_{101}=X_{100}\pm R_J/\{1+(dX_{100}/dY_{100})^2\}^{1/2} \quad \text{Formula 25}$$

$$Y_{101}=Y_{100}\pm R_J/\{1+(dX_{100}/dY_{100})^2\}^{1/2} \quad \text{Formula 26}$$

where,

X axis: the straight line extending through the center of the inner rotor,

Y axis: the straight line perpendicular to the X axis and extending through the center of the inner rotor, $(X_{100}, Y_{100})$: coordinates on the trochoid curve, $R_H$: the radius of a basic circle of the trochoid curve, $R_I$: the radius of a trochoid curve generating circle, $e_K$: a distance between the center of the trochoid curve generating circle and a point generating the trochoid curve, $\theta_{100}$: an angle formed between the X axis and a straight line extending through the center of the trochoid curve generating circle and the inner rotor center, $\theta_{101}$: an angle formed between the X axis and a straight line extending through the center of the trochoid curve generating circle and the trochoid curve generating point, $(X_{101}, Y_{101})$: coordinates on the envelope, and $R_J$: the radius of the arcs E forming the envelope $$R_{11}=(X_{101}^2+Y_{101}^2)^{1/2} \quad \text{Formula 27}$$

$$\theta_{102}=\arccos(X_{101}/R_{11}) \quad \text{Formula 28}$$

$$X_{102}=\{(R_{11}-R_{D1})\times\beta_{100}+R_{D1}\}\times\cos\theta_{102} \quad \text{Formula 29}$$

$$Y_{102}=\{(R_{11}-R_{D1})\times\beta_{100}+R_{D1}\}\times\sin\theta_{102} \quad \text{Formula 30}$$

where, $R_{11}$: a distance from the inner rotor center to the coordinates $(X_{101}, Y_{101})$, $\theta_{102}$: an angle formed between the X axis and the straight line extending through the inner rotor center and the straight line extending through the coordinates $(X_{101}, Y_{101})$, $(X_{102}, Y_{102})$: coordinates of the addendum profile after modification, and $\beta_{100}$: a correction factor for modification $$R_{21}=(X_{101}^2+Y_{101}^2)^{1/2} \quad \text{Formula 31}$$

$$\theta_{103}=\arccos(X_{101}/R_{21}) \quad \text{Formula 32}$$

$$X_{103}=\{R_{D2}-(R_{D2}-R_{21})\times\beta_{101}\}\times\cos\theta_{103} \quad \text{Formula 33}$$

$$Y_{103}=\{R_{D2}-(R_{D2}-R_{21})\times\beta_{101}\}\times\sin\theta_{103} \quad \text{Formula 34}$$

$R_{21}$: a distance from the inner rotor center to the coordinates $(X_{101}, Y_{101})$, $\theta_{103}$: an angle formed between the X axis and the straight line extending through the inner rotor center and the straight line extending through the coordinates $(X_{101}, Y_{101})$, $(X_{103}, Y_{103})$: coordinates of the root profile after modification, and $\beta_{101}$: a correction factor for modification.

10. The oil pump rotor according to claim 9, wherein relative to a tooth profile formed by an arcuate curve represented by Formals 81 through 84 and having a root circle B1 with a radius $R_{B1}$ *and* an addendum circle B2 with a radius $R_{B2}$;

the internal tooth profile of the outer rotor meshing with the inner rotor has a root profile represented by Formula 85 in case said internal tooth profile is provided as a modification on the outer side of a circle $D_3$ having a radius $R_{D3}$ satisfying: $R_{B1}>R_{D3}>R_{B2}$;

the internal tooth profile of the outer rotor meshing with the inner rotor has an addendum profile represented by Formulas 86 and 87 in case said internal tooth profile is provided as a modification on the inner side of a circle $D_4$ having a radius $R_{D4}$ satisfying: $R_{B1}>R_{B4}>R_{B2}$ and $R_{D3}>R_{D4}$;

$$(X_{200}-X_{210})^2+(Y_{200}-Y_{210})^2=R_J^2 \quad \text{Formula 81}$$

$$X_{210}^2+Y_{210}^2=R_L^2 \quad \text{Formula 82}$$

$$X_{220}^2+Y_{220}^2=R_{B1}^2 \quad \text{Formula 83}$$

$$R_{B1}=(3\times R_{A1}-R_{A2})/2+g_{10} \quad \text{Formula 84}$$

where,

X axis: a straight line extending through the center of the outer rotor,

Y axis: a straight line perpendicular to the X axis and extending through the outer rotor center, $(X_{200}, Y_{200})$: coordinates of an arc forming the addendum portion, $(X_{210}, Y_{210})$: coordinates of the center of the circle whose arc forms the addendum portion, $(X_{220}, Y_{220})$: coordinates of an arc of the addendum circle Bl forming the addendum portion, $R_L$: a distance between the outer rotor center and the center of the circle forming whose arc forms the addendum portion, and $R_{B1}$: a radius of the root circle Bl forming the root portion $$X_{230}^2+Y_{230}^2=R_{B1}'^2 \quad \text{Formula 85}$$

where, $(X_{230}, Y_{230})$: coordinates of the root profile after the modification, and $R_{B1}'$: a radius of the arc forming the root portion after the modification $$X_{201}=(1-\beta_{200})\times R_{D4}\times\cos\theta_{200}+X_{200}\times\beta_{200}+g_{20} \quad \text{Formula 86}$$

$$Y_{201}=(1-\beta_{200})\times R_{D4}\times\sin\theta_{200}+Y_{200}\times\beta_{200}+g_{30} \quad \text{Formula 87}$$

where, $(X_{201}, Y_{201})$: coordinates of the addendum profile after the modification, $\theta_{200}$: an angle formed between the X axis and the straight line extending through the outer rotor center and the point $(X_{200}, Y_{200})$, $\beta_{200}$: a correction factor for modification, and $g_{10}$, $g_{20}$, $g_{30}$: correction amounts for allowing outer rotor rotation with clearance.

11. An oil pump rotor for use in an oil pump including an inner rotor having n external teeth, wherein n is a natural number, an outer rotor having n+1 internal teeth meshing with the external teeth, and a casing forming a suction port for drawing a fluid and a discharge port for discharging the fluid, such that in association with meshing and co-rotation of the inner and outer rotors, the fluid is drawn/discharged to be conveyed according to volume changes of cells formed between teeth faces of the two rotors;

wherein, for a tooth profile formed of a mathematical curve and having a tooth addendum circle A1 with a radius $R_{A1}$ and a tooth root curve $A_2$ with a radius $R_{A2}$, a circle $D_1$ has a radius $R_{D1}$ which satisfies at least Formula 1, $$R_{A1}>R_{D1}>R_{A2} \quad \text{Formula 1}$$

$$R_{A1}>R_{D2}>R_{A2} \quad \text{Formula 2}$$

$$R_{D1}\geq R_{D2} \quad \text{Formula 3}$$

a tooth profile of the external teeth of the inner rotor comprises at least either one of a modification, in a radially outer direction, of said tooth profile, on the outer side of said circle $D_1$ and a modification, in a radially inner direction, of said tooth profile, on the inner side of a circle $D_2$;

wherein said tooth profile of the external teeth of the inner rotor is formed of both the radially outer modification of the tooth profile, on the outer side of the circle $D_1$ having the radius $R_{D1}$ satisfying said Formula 1 and the radially inner modification of said tooth profile, on the inner side of the circle $D_2$ having the radius $R_{D2}$ satisfying both Formula 2 and Formula 3; and wherein said mathematical curve is formed by two arcs having an addendum portion and a root portion tangent to each other and is an arcuate curve represented by Formulas 41 through 46, and said external tooth profile of the inner rotor, in the case of the modification on the outer side of the circle $D_1$, has an addendum profile represented by coordinates obtained by Formulas 47 through 50, whereas said external tooth profile of the inner rotor, in the case of the modification on the inner side of the circle $D_2$, has a root profile represented by coordinates obtained by Formulas 51 through 54

$$(X_{50}-X_{60})^2+(Y_{50}-Y_{60})^2=(r_{50}+r_{60})^2 \quad \text{Formula 41}$$

$$X_{60}=(R_{A2}+r_{60})\cos\theta_{60} \quad \text{Formula 42}$$

$$Y_{60}=(R_{A2}+r_{80})\sin\theta_{60} \quad \text{Formula 43}$$

$$X_{50}=R_{A1}-r_{50} \quad \text{Formula 44}$$

$$Y_{50}=0 \quad \text{Formula 45}$$

$$\theta_{60}=\pi/n \quad \text{Formula 46}$$

where,

X axis: a straight line extending through the center of the inner rotor,

Y axis: a straight line perpendicular to the X axis and extending through the center of the inner rotor, $(X_{50}, Y_{50})$: coordinates of the center of the arc forming the tooth addendum portion, $(X_{60}, Y_{60})$: coordinates of the center of the arc forming the tooth root portion, $r_{50}$: the radius of the arc forming the tooth addendum portion, $r_{60}$: the radius of the arc forming the tooth root portion, $\theta_{60}$: an angle formed between the straight line extending through the center of the arc foaming the tooth addendum portion and the center of the inner rotor and the straight line extending through the center of the arc forming the tooth root portion and the center of the inner rotor, $$R_{51}=(X_{51}^2+Y_{51}^2)^{1/2} \quad \text{Formula 47}$$

$$\theta_{51}=\arccos(X_{51}/R_{51}) \quad \text{Formula 48}$$

$$X_{52}=\{(R_{51}-R_{D1})\times\beta_{50}+R_{D1}\}\times\cos\theta_{51} \quad \text{Formula 49}$$

$$Y_{52}=\{(R_{51}-R_{D1})\times\beta_{50}+R_{D1}\}\times\sin\theta_{51} \quad \text{Formula 50}$$

where, $(X_{51}, Y_{51})$: coordinates of the points on the arc forming the tooth addendum portion, $R_{51}$: a distance from the center of the inner rotor to the coordinates $(X_{51}, Y_{51})$, $\theta_{51}$: an angle formed between the X axis and the straight line extending through the center of the inner rotor and the coordinates $(X_{51}, Y_{51})$, $(X_{52}, Y_{52})$: the coordinates of the addendum profile after the modification,)

$\beta_{50}$: a correction factor for modification $$R_{61}=(X_{61}^2+Y_{61}^2)^{1/2} \quad \text{Formula 51}$$

$$\theta_{61}=\arccos(X_{61}/R_{61}) \quad \text{Formula 52}$$

$$X_{62}=\{R_{D2}-(R_{D2}-R_{61})\times\beta_{60}\}\times\cos\theta_{61} \quad \text{Formula 53}$$

$$Y_{62}=\{R_{D2}-(R_{D2}-R_{61})\times\beta_{60}\}\times\cos\theta_{61} \quad \text{Formula 54}$$

where, $(X_{61}, Y_{61})$: coordinates of the points on the arc forming the tooth root portion, $R_{61}$: a distance from the center of the inner rotor to the coordinates $(X_{61}, Y_{61})$, $\theta_{61}$: an angle formed between the X axis and the straight line extending through the center of the inner rotor and the coordinates $(X_{61}, Y_{61})$, $(X_{62}, Y_{62})$: the coordinates of the root profile after the modification, $\beta_{60}$: a correction factor for modification.

12. The oil pump rotor according to claim 11, wherein relative to a tooth profile formed by an arcuate curve represented by Formals 101 through 106 and having a root circle B1 with a radius $R_{B1}$ and an addendum circle B2 with a radius $R_{B2}$;

the internal tooth profile of the outer rotor meshing with the inner rotor has a root profile represented by Formulas 107 through 110 in case said internal tooth profile is provided as a modification on the outer side of a circle $D_3$ having a radius $R_{D3}$ satisfying: $R_{B1}>R_{D3}>R_{B2}$;

the internal tooth profile of the outer rotor meshing with the inner rotor has an addendum profile represented by Formulas 111 through 114 in case said internal tooth profile is provided as a modification on the inner side of a circle $D_4$ having a radius $R_{D4}$ satisfying: $R_{B1}>R_{D4}>R_{B2}$ and $R_{D3}=R_{D4}$; and the internal tooth profile of the outer rotor satisfies the following relationships of Formulas 115 through 117 relative to the inner rotor;

$$(X_{70}-Y_{80})^2+(Y_{70}-Y_{80})^2=(r_{70}+r_{80})^2 \quad \text{Formula 101}$$

$$X_{80}=(R_{B2}+r_{80})\cos\theta_{80} \quad \text{Formula 102}$$

$$Y_{80}=(R_{B2}+r_{80})\sin\theta_{80} \quad \text{Formula 103}$$

$$X_{70}=R_{B1}-r_{70} \quad \text{Formula 104}$$

$$Y_{70}=0 \quad \text{Formula 105}$$

$$\theta_{80}=\pi/(n+1) \quad \text{Formula 106}$$

where,

X axis: a straight line extending through the center of the outer rotor,

Y axis: a straight line perpendicular to the X axis and extending through the center of the outer rotor, $(X_{70}, Y_{70})$: coordinates of the center of the arc forming the root portion, $(X_{80}, Y_{80})$: coordinates of the center of the arc forming the addendum portion, $r_{70}$: the radius of the arc forming the root portion, $r_{80}$: the radius of the arc forming the addendum portion, $\theta_{80}$: an angle formed between the straight line extending through the center of the arc forming the addendum portion and the center of the outer rotor and the straight line extending through the center of the arc forming the root portion and the center of the outer rotor, $$R_{71}=(X_{71}^2+Y_{71}^2)^{1/2} \quad \text{Formula 107}$$

$$\theta_{71}=\arccos(X_{71}/R_{71}) \quad \text{Formula 108}$$

$$X_{72}=\{(R_{71}-R_{D3})\times\beta_{70}+R_{D3}\}\times\cos\theta_{71} \quad \text{Formula 109}$$

$$Y_{72}=\{(R_{71}-R_{D3})\times\beta_{70}+R_{D3}\}\times\sin\theta_{71} \quad \text{Formula 110}$$

where, $(X_{71}, Y_{71})$: coordinates of the point on the arc forming the addendum portion, $R_{71}$: a distance from the center of the outer rotor to the coordinates $(X_{71}, Y_{71})$, $\theta_{71}$:an angle formed between the X axis and the straight line extending through the center of the outer rotor and the coordinates $(X_{71}, Y_{71})$, $(X_{72}, Y_{72})$: the coordinates of the addendum profile after the modification, $\beta_{70}$: a correction factor for modification $$R_{81}=(X_{81}^2+Y_{81}^2)^{1/2} \quad \text{Formula 111}$$

$$\theta_{81}=\arccos(X_{81}/R_{81}) \quad \text{Formula 112}$$

$$X_{81}=\{R_{D4}-(R_{D4}-R_{81})\times\beta_{80}\}\times\cos\theta_{81} \quad \text{Formula 113}$$

$$Y_{81}=\{R_{D4}-(R_{D4}-R_{81})\times\beta_{80}\}\times\sin\theta_{81} \quad \text{Formula 114}$$

where, $(X_{81}, Y_{81})$. coordinates of the point on the arc forming the addendum portion, $R_{81}$: a distance from the center of the outer rotor to the coordinates $(X_{81}, Y_{81})$, $\theta_{81}$ an angle formed between the X axis and the straight line extending through the center of the outer rotor and the coordinates $(X_{81}, Y_{81})$, $(X_{82}, Y_{82})$: the coordinates of the addendum profile after the modification, $\beta_{80}$: a correction factor for modification $$e_{50}=[\{(R_{A1}-R_{D1})\times\beta_{50}+R_{D1}\}-\{R_{D2}-(R_{D2}-R_{A2})\times\beta_{60}\}]/2+d_{50} \quad \text{Formula 115}$$

$$R_{B1}'=3/2[\{R_{A1}-R_{D1}\}\times\beta_{50}+R_{D1}]-1/2\times\{R_{D2}-(R_{D2}-R_{A2})\times\beta_{60}\}+d_{60} \quad \text{Formula 116}$$

$$R_{B2}'=[\{(R_{A1}-R_{D1})\times\beta_{50}+R_{D1}\}+\{R_{D2}-(R_{D2}-R_{A2})\times\beta_{60}\}]/2+d_{70} \quad \text{Formula 117}$$

where, $e_{50}$: a distance between the center of the inner rotor and the center of the outer rotor (eccentricity amount), $R_{B1}'$: the radius of the root circle of the outer rotor after the modification, $R_{B2}'$: the radius of the addendum circle of the outer rotor after the modification, and $d_{50}$, $d_{60}$, $d_{70}$: correction amounts for allowing outer rotor rotation with clearance.

* * * * *